US006435774B1

(12) United States Patent
Khachaturian

(10) Patent No.: US 6,435,774 B1
(45) Date of Patent: Aug. 20, 2002

(54) ARTICULATED MULTIPLE BUOY MARINE PLATFORM APPARATUS

(76) Inventor: Jon Khachaturian, 5427 Sutton Pl., New Orleans, LA (US) 70131

( * ) Notice: Subject to any disclaimer, the term of this patent is extended or adjusted under 35 U.S.C. 154(b) by 0 days.

(21) Appl. No.: 09/727,343

(22) Filed: Nov. 29, 2000

Related U.S. Application Data

(63) Continuation of application No. 09/693,470, filed on Oct. 20, 2000.
(60) Provisional application No. 60/213,034, filed on Jun. 21, 2000.

(51) Int. Cl.[7] ..... E02D 17/08
(52) U.S. Cl. ..... 405/202; 405/200
(58) Field of Search ..... 405/195.1, 205, 405/223.1, 224, 196, 202; 114/65 R

(56) References Cited

U.S. PATENT DOCUMENTS

| | | | | |
|---|---|---|---|---|
| 3,519,036 A | | 7/1970 | Manning | |
| 3,708,985 A | | 1/1973 | Pogonowski | |
| 3,736,756 A | * | 6/1973 | Lloyd | 64/46.5 |
| 3,977,346 A | * | 8/1976 | Natvig et al. | 114/65 R |
| 4,026,119 A | | 5/1977 | Dotti | |
| 4,106,146 A | | 8/1978 | Maari | |
| 4,155,670 A | * | 5/1979 | Stafford | 405/202 |
| 4,249,618 A | | 2/1981 | Lamy | |
| 4,359,164 A | * | 11/1982 | Triplett | 212/182 |
| 4,436,454 A | | 3/1984 | Ninet et al. | |
| 4,470,723 A | * | 9/1984 | Michel et al. | 405/202 |
| 4,538,939 A | * | 9/1985 | Johnson | 405/205 |
| 4,588,328 A | * | 5/1986 | Ghilardi et al. | 405/202 |
| 4,674,918 A | | 6/1987 | Kalpins | |
| 4,702,321 A | | 10/1987 | Horton | |
| 4,714,382 A | * | 12/1987 | Khachaturian | 405/204 |
| 4,733,991 A | | 3/1988 | Myers | |
| 4,913,238 A | | 4/1990 | Danazcko et al. | |
| 4,930,924 A | | 6/1990 | Hunt | |
| 4,930,938 A | | 6/1990 | Rawstron et al. | |
| 4,966,495 A | * | 10/1990 | Goldman | 405/224 |
| 5,403,124 A | | 4/1995 | Kocaman et al. | |
| 5,443,330 A | * | 8/1995 | Copple | 405/224.2 |
| 5,542,783 A | | 8/1996 | Pollack | |
| 5,553,977 A | * | 9/1996 | Andersen et al. | 405/204 |
| 5,846,028 A | * | 12/1998 | Thory | 405/195.1 |
| 5,931,602 A | * | 8/1999 | Gulbrandsen et al. | 405/224 |
| 6,149,350 A | | 11/2000 | Khachaturian | |
| 6,171,028 B1 | | 1/2001 | Van Gelder | |

OTHER PUBLICATIONS

2000 Worldwide Survey of Deepwater Production Solutions, Offshore Magazine, Sep. 2000.

* cited by examiner

*Primary Examiner*—Thomas B. Will
*Assistant Examiner*—Raymond Addie
(74) *Attorney, Agent, or Firm*—Garvey, Smith, Nehrbass & Doody, LLC

(57) ABSTRACT

A marine platform provides a plurality of buoys, a platform having a peripheral portion that includes a plurality of attachment positions, one attachment position for each buoy, and a connection that connects each buoy to the platform at a respective attachment position, the connection allowing for sea state induced buoy motions while minimizing effect on the platform. Each connection can provide first and second portions (or devices) and a load transfer mechanism that transfers load from the first portion to the second portion so that one of the portions (or devices) can be serviced.

84 Claims, 17 Drawing Sheets

ARTICULATED MULTIPLE BUOY MARINE PLATFORM APPARATUS

CROSS-REFERENCE TO RELATED APPLICATIONS

This is a continuation-in-part of U.S. paternt application Ser. No. 09/693,470, filed Oct. 20 2000, which is incorporated herein by reference.

Priority of U.S. Provisional Patent Application Ser. No. 60/213,034, filed Jun. 21, 2000, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to floating marine platforms. More particularly, the present invention relates to a novel multiple buoy platform that supports a platform with a plurality of buoys and wherein a specially configured multiple device support enables replacement of one device while the other supports the platform.

2. General Background of the Invention

Many types of marine platforms have been designed, patented and used commercially. Marine platforms typically take the form of either fixed platforms that include a large underwater support structure or "jacket" or a floating platform having a submersible support. Sometimes these platforms are called semi-submersible rigs.

Jack-up barges are another type of platform that can be used in an offshore marine environment for drilling/production. Jack-up barges have a barge with long legs that can be powered up for travel and powered down to elevate the barge above the water.

Other types of platforms for deep water (1500 feet or deeper) have been patented. The September 2000 issue of Offshore Magazine shows many floating offshore platforms for use in deep water drilling and/or production. Some of the following patents relate to offshore platforms, some of which are buoy type offshore platforms, all of which are hereby incorporated herein by reference. Other patents have issued that relate in general to floating structures, and include some patents disclosing structures that would not be suitable for use in oil and gas well drilling and/or production.

| PATENT # | ISSUE DATE | TITLE |
|---|---|---|
| 3,540,396 | 11/17/70 | Offshore Well Apparatus and System |
| 4,297,965 | 11/03/81 | Tension leg Structure for Tension Leg Platform |
| 5,439,060 | 08/08/95 | Tensioned Riser Deepwater Tower |
| 5,558,467 | 09/24,96 | Deep Water offshore Apparatus |
| 5,706,897 | 01/13/98 | Drilling, Production, Test, and Oil Storage Caisson |
| 5,722,797 | 03/03/98 | Floating Caisson for Offshore Production and Drilling |

-continued

| PATENT # | ISSUE DATE | TITLE |
|---|---|---|
| 5,873,416 | 02/23/99 | Drilling, Production, Test, and Oil Storage Caisson |
| 5,924,822 | 07/20/99 | Method for Deck Installation on an Offshore Substructure |
| 6,012,873 | 01/11/00 | Buoyant Leg Platform With Retractable Gravity Base and Method of Anchoring and Relocating the Same |
| 6,027,286 | 02/22/00 | Offshore Spar Production System and Method for Creating a Controlled Tilt of the Caisson Axis |

One of the problems with the spar type construction is that the single spar must be enormous and thus very expensive to manufacture, transport, and install if it is supporting a drilling rig or production platform weighing between 5,000 and 40,000 tons, for example (or even a package of between 500–100,000 tons).

BRIEF SUMMARY OF THE INVENTION

The present invention provides an improved offshore marine platform that can be used for drilling for oil and/or gas or in the production of oil and gas from an offshore environment. Such drilling and/or production facilities typically weigh between 500–100,000 tons, more commonly between 3000–50,000 tons.

The apparatus of the present invention thus provides a marine platform that is comprised of a plurality of spaced apart buoys, the platform having a periphery that includes a plurality of attachment positions, one attachment position for each buoy.

Each of the buoys will move due to current and/or wind and/or wave action or due to other dynamic marine environmental factors. "Articulating connection" as used herein should be understood to mean any connection or joint that connects a buoy to the superstructure, transmits axial and shear forces, and allows the support buoy(s) to move relative to the superstructure without separation, and wherein the bending moment transferred to the superstructure from one of the so connected buoys or from multiple of the so connected buoys is reduced, minimized or substantially eliminated. "Articulating connection" is a joint movably connecting a buoy to a superstructure wherein axial and tangential forces are substantially transmitted, however, transfer of bending moment is substantially reduced or minimized through the joint allowing relative movement between the buoy and the superstructure.

A connection (which can be an articulating connection) connects each buoy to the platform at a respective attachment position, the connection allowing for sea state induced buoy motions while minimizing effects on the platform.

The apparatus of the present invention provides a marine platform that can further comprise a mooring extending from a plurality of the buoys for holding the platform and buoys to a desired location.

In a preferred embodiment, the present invention provides a marine platform wherein each of the articulating connections includes corresponding concave and convex engaging portions. In another embodiment, a universal type joint is disclosed.

In another embodiment a marine platform has buoys with convex articulating portions and the platform has correspondingly shaped concave articulating portions.

In a preferred embodiment, each buoy can be provided with a concave articulating portion and the platform with a convex articulating portion.

In a preferred embodiment, each buoy has a height and a diameter. In a preferred embodiment, the height is much greater than the diameter for each of the buoys.

In the preferred embodiment, each buoy is preferably between 25 and 100 feet in diameter.

The apparatus of the present invention preferably provides a plurality of buoys, wherein each buoy is between about 100 and 500 feet in height.

The buoys can be of a generally uniform diameter along a majority of the buoy. However, each buoy can have a variable diameter in an alternate embodiment.

In a preferred embodiment, each buoy is generally cylindrically shaped. However, each buoy can be provided with simply an upper end portion that is generally cylindrically shaped.

In a preferred embodiment, there are at least three buoys and at least three attachment positions, preferably four buoys and four attachment positions.

In a preferred embodiment, each articulated connection is preferably hemispherically shaped for the upper end portion of each buoy and there is a correspondingly concavely shaped receptacle on the platform that fits the surface of each hemispherically shaped upper end portion.

The connection can also be in the form of a universal joint. In an additional embodiment, the connection can be in the form of first and second devices that provide "backup" or redundancy that enables one device to be serviced while the other supports the platform. In this embodiment, a first universal joint preferably carries load between the platform and each buoy over the long period of time. In the event that the first device must be replaced or serviced, a jacking arrangement loads the other device so that the first device does not carry load and can be removed.

The devices can include an inner device and an outer device. The "devices" can be articulating devices such as universal joints.

In a preferred embodiment, the platform is comprised of a trussed deck. The trussed deck preferably has lower horizontal members, upper horizontal members and a plurality of inclined members spanning between the upper and lower horizontal members, and wherein the attachment positions are next to the lower horizontal member.

In a preferred embodiment, the apparatus supports an oil and gas well drilling and/or production platform weighing between 500 and 100,000 tons, more particularly, weighing between 3,000 tons and 50,000.

The apparatus of the present invention uses articulating connections between the submerged portion of the buoy and the superstructure to minimize or reduce topside, wave induced motions during the structural life of the apparatus.

The apparatus of the present invention thus enables smaller, multiple hull components to be used to support the superstructure than a single column or single buoy floater.

With the present invention, the topside angular motion is reduced and is less than the topside angular motion of a single column floater of comparable weight.

With the present invention, there is substantially no bending moment or minimum bending moment transferred between each buoy and the structure being supported. The present invention thus minimizes or substantially eliminates moment transfer at the articulating connection that is formed between each buoy and the structure being supported. The buoys are thus substantially free to move in any direction relative to the supported structure or load excepting motion that would separate a buoy from the supported structure.

The present invention has particular utility in the supporting of oil and gas well drilling facilities and oil and gas well drilling production facilities. The apparatus of the present invention has particular utility in very deep water, for example, in excess of 1500 feet.

The present invention also has particular utility in tropical environments (for example West Africa and Brazil) wherein the environment produces long period swell action.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIG. 14 is rotated 90 degrees from FIG. 13 around the longitudinal axis of the buoy;

DETAILED DESCRIPTION OF THE INVENTION

Figure 1:
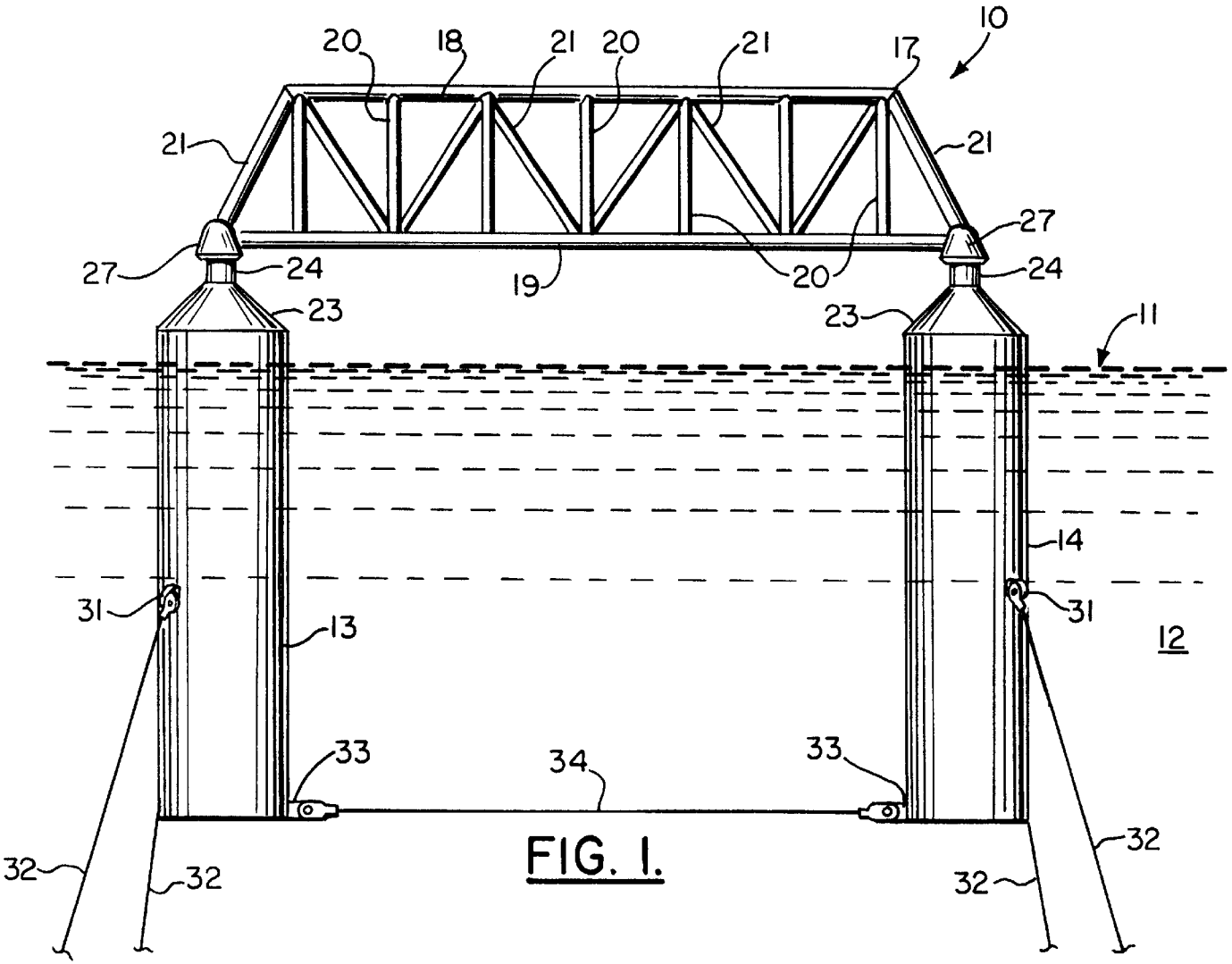
FIG. 1 is an elevation view of a preferred embodiment of the apparatus of the present invention.

FIGS. 1–6 show a preferred embodiment of the apparatus of the present invention designated generally by the numeral 10 in FIGS. 1–4. In FIGS. 1–4, floating marine platform apparatus 10 is shown in a marine environment or ocean 12 having a water surface 11. The apparatus 10 includes a plurality of buoys 13–16, preferably four (optionally between three (3) and eight (8)), that support a superstructure defined by the combination of platform 17 and drilling and/or producing facilities 53. Oil and gas well producing facility as used herein shall include a facility used for oil and gas well drilling or production, or a combination of drilling and production.

Buoys 13–16 can be any desired shape, including the alternate buoys shown in the drawings or buoys with configurations like those in the September 2000 issue of Offshore Magazine. Platform 17 can be any desired platform or rig, such as a trussed deck constructed of a plurality of upper horizontal members 18, a plurality of lower horizontal members 19, a plurality of vertical members 20 and a plurality of diagonal members 21 to define a trussed deck or platform 17. As shown in FIG. 1, platform 17 can include any desired oil and gas drilling and/or production facility 53, such facilities (in combination with platform 17) defining a superstructure weighing between about 500–100,000 tons, (or between about 3000–50,000 tons). (See FIGS. 3 and 8).

Figure 5:
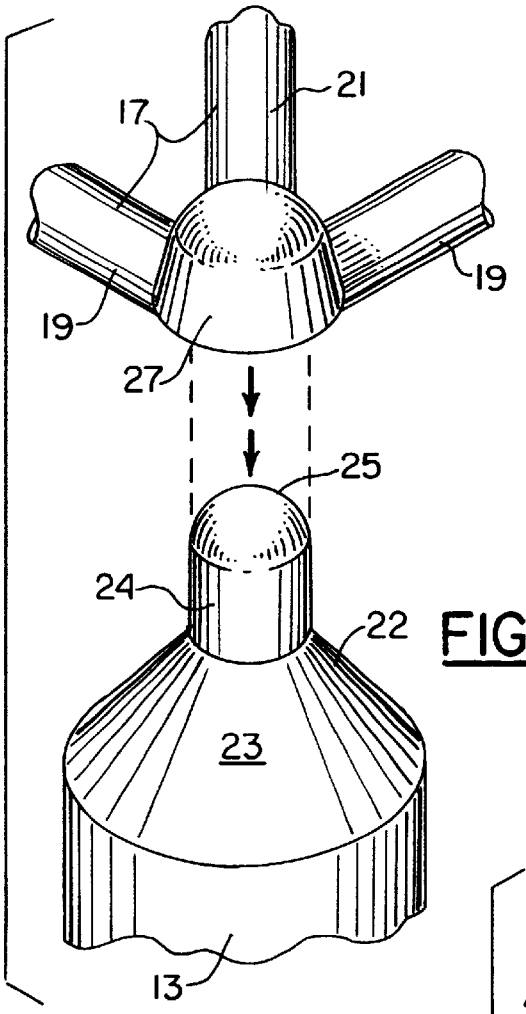
FIGS. 5–6 are fragmentary perspective views of the preferred embodiment of the apparatus of the present invention illustrating the articulating connection between a buoy and the platform.
Figure 6:
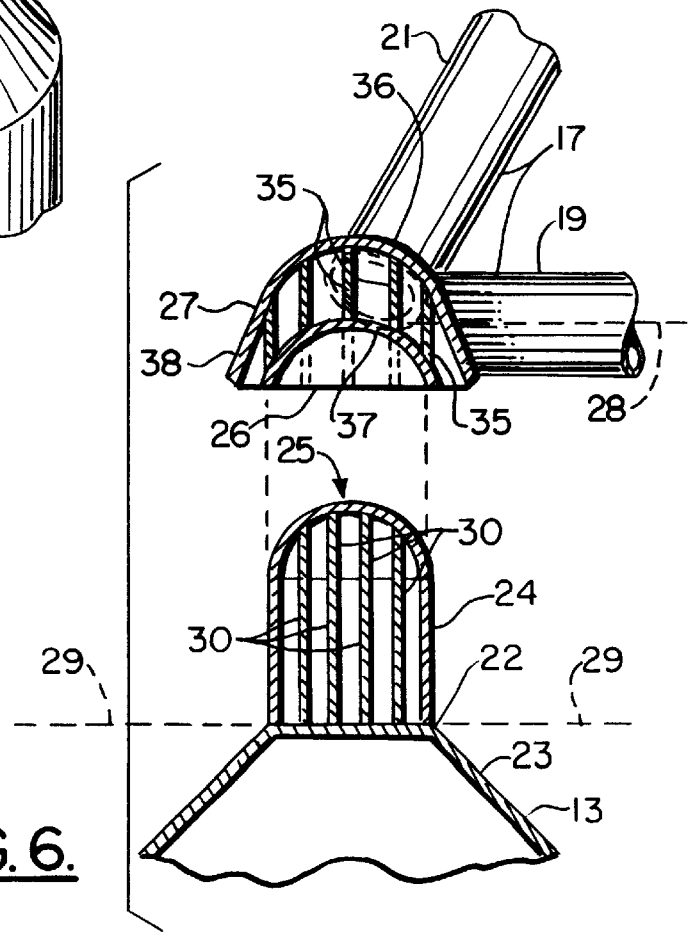

Each buoy 13–16 has an upper end portion 22 that can be conically shaped at 23 (see FIGS. 5–6). An attachment portion 24 provides a convex upper surface 25 that receives a correspondingly shaped concave surface 26 of connecting portion 27 of platform 17. The concave surface 26 can be generally hemispherically shaped. However, the concave surface 26 is curved to articulate upon the surface 25. Surface 26 is preferably smaller than a full hemispherical surface, sized to articulate upon surface 25 even wherein there is an angular variation that can be as much as 30 degrees (or more) between the central longitudinal axis 28 of buoy 13 and a pure horizontal plane 29. To address wear, bearing materials may be used in the articulating connections which are conventionally available. A preferred bearing material would be a graphite impregnated brass or bronze bushing.

The following equations can be used in sizing the buoys:

$$\text{Heave Period } T(\text{heave})=2\pi\sqrt{(M/K)}$$

Where $M$=total Heave mass;

$K$=Heave stiffness;

$$\text{Heave Stiffness } K=\tfrac{1}{4}\pi D^2 G$$

Where $D$=the diameter of the section of the buoy passing through the water plane;

$G$=the unit weight of water (approximately 65 pounds per cubic foot);

$$\text{Heave Mass } M=(\text{Dry buoy mass})+(\text{entrapped fluid mass})+(\text{permanent solid ballast mass})+(\text{added virtual fluid mass})$$

The buoys may be constructed of stiffened steel plate, or continuously cast (slip formed) concrete or through other conventional construction techniques. Typically, a number of internal stiffeners are included to provide the required overall structural strength.

The attachment portion 24 at the upper end of each buoy 13–16 can be reinforced with a plurality of vertical plates 30 as shown in FIG. 6. Likewise, the connection portion 27 of platform 17 can be provided with a plurality of internal reinforcing plates 35. The plates 35 extend between upper curved plate 36 and lower curved plate 37. A conical plate 38 can be attached to (or can be integral with) upper curved plate 36 as shown in FIG. 6. A square harness articulating connection (not shown) going around the primary articulating connection may also be used.

Platform apparatus 10 can be secured to the sea bed 51 using piling or anchors 52 and mooring lines 32, 41 (FIGS. 1–4, 8). In a preferred embodiment (FIGS. 1–4), one or more mooring lines 32 extend from each buoy 13–16 at an upper padeye 31 to the sea bed 51. The mooring lines in FIGS. 1, 2, 3 and 4 extend between padeyes 31 and anchors 52 at sea bed 51.

In a preferred embodiment, a plurality of horizontal mooring lines 34 extend between lower padeyes 33 on two buoys 13, 14 as shown in FIG. 1. While the lower horizontal mooring lines 34 are shown connecting to buoys 13, 14, it should be understood that each pair of buoys (14–15, 15–16, 16–13) has a horizontal line 34 extending there between in the same configuration shown in FIG. 1.

Figure 7:
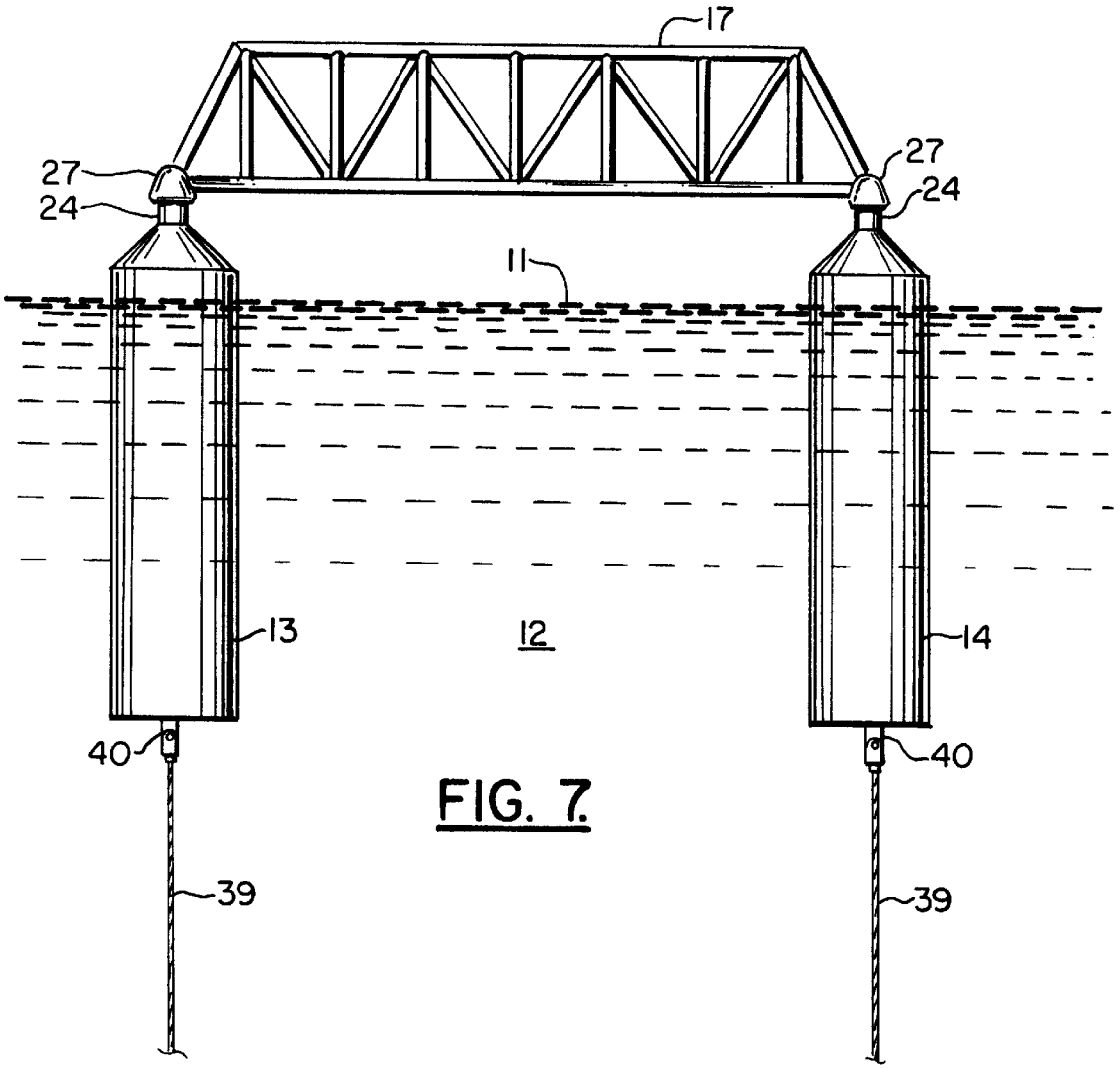
FIGS. 7–8 show alternate mooring arrangements for the apparatus of the present invention.

FIG. 7 shows a first alternate embodiment of the present invention, utilizing tensioned mooring lines 39 that extend between connection points (eg. padeyes) 40 on each of the buoys 13–16 and anchors (such as 52) embedded in the sea bed 51. In the embodiment of FIG. 7, horizontal mooring lines 34 could optionally be provided between each pair of buoys such as 13 and 14, or 14 and 15, or 15 and 16, or 16 and 13.

Figure 8:
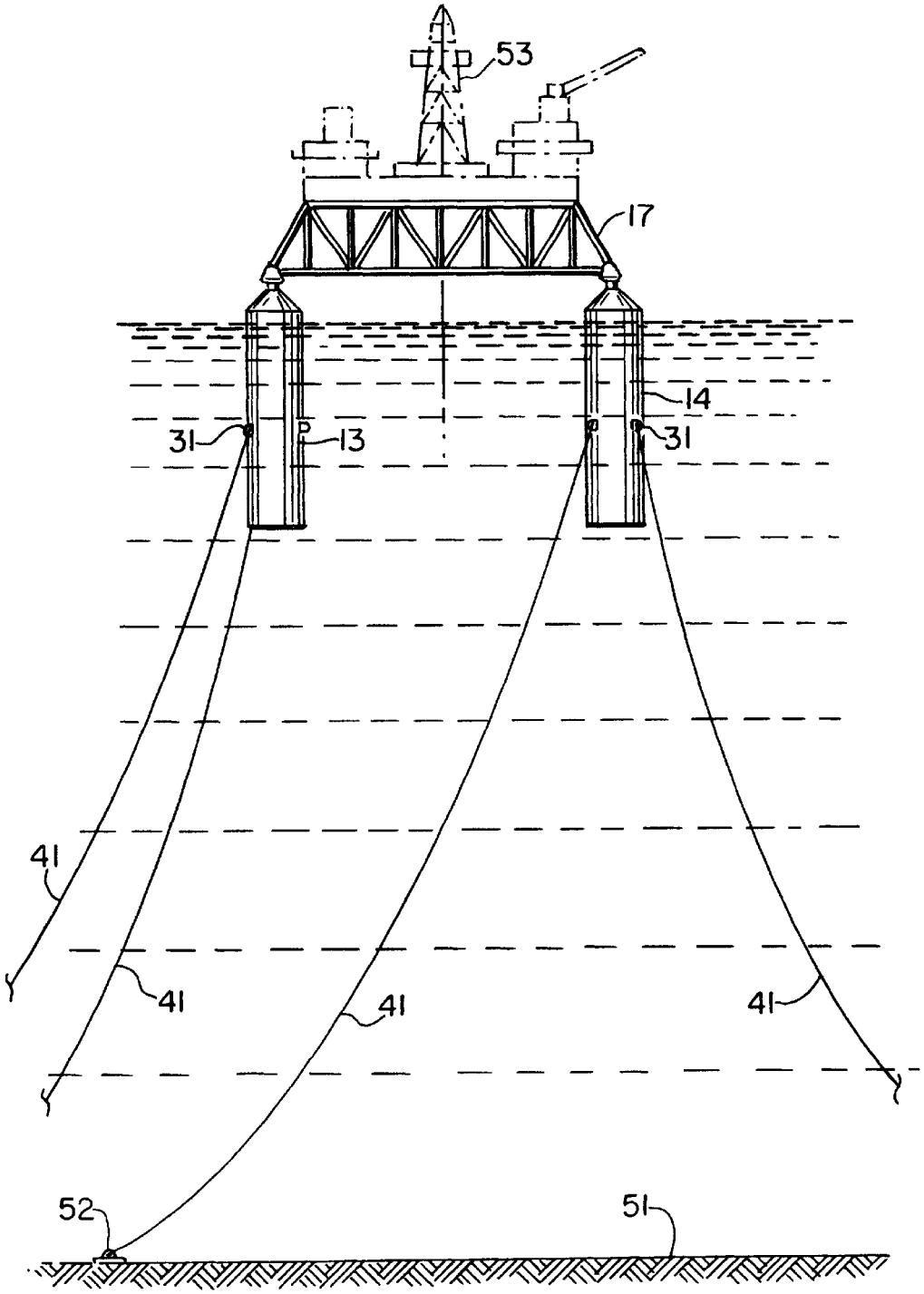

FIG. 8 shows an alternate arrangement wherein caternary mooring lines 41 extend between padeyes 31 and the anchors 52 that are anchored to the sea bed 51.

Figure 2:
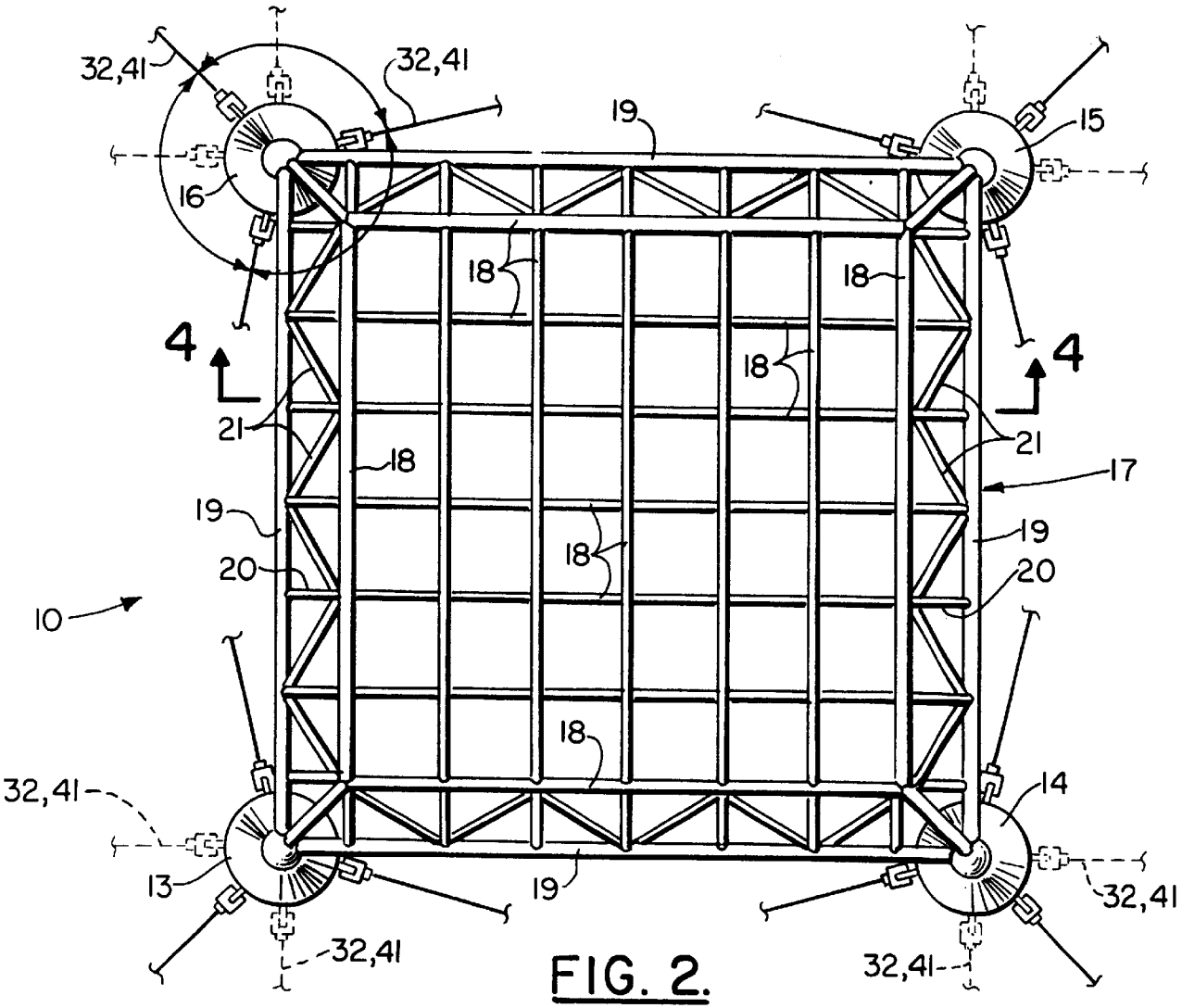
FIG. 2 is a plan view of a preferred embodiment of the apparatus of the present invention.
Figure 3:
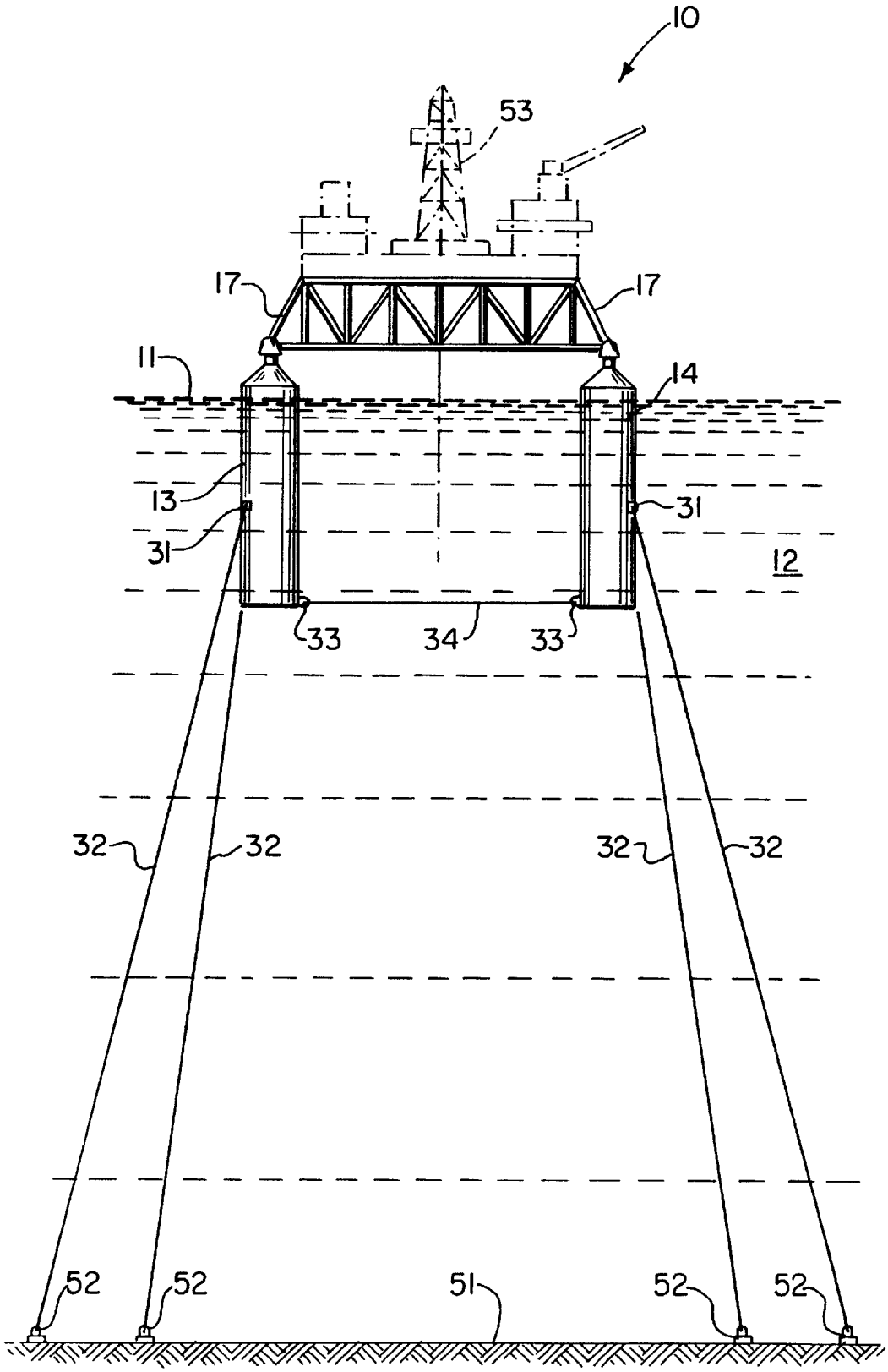
FIG. 3 is an elevation view of a preferred embodiment of the apparatus of the present invention.
Figure 4:
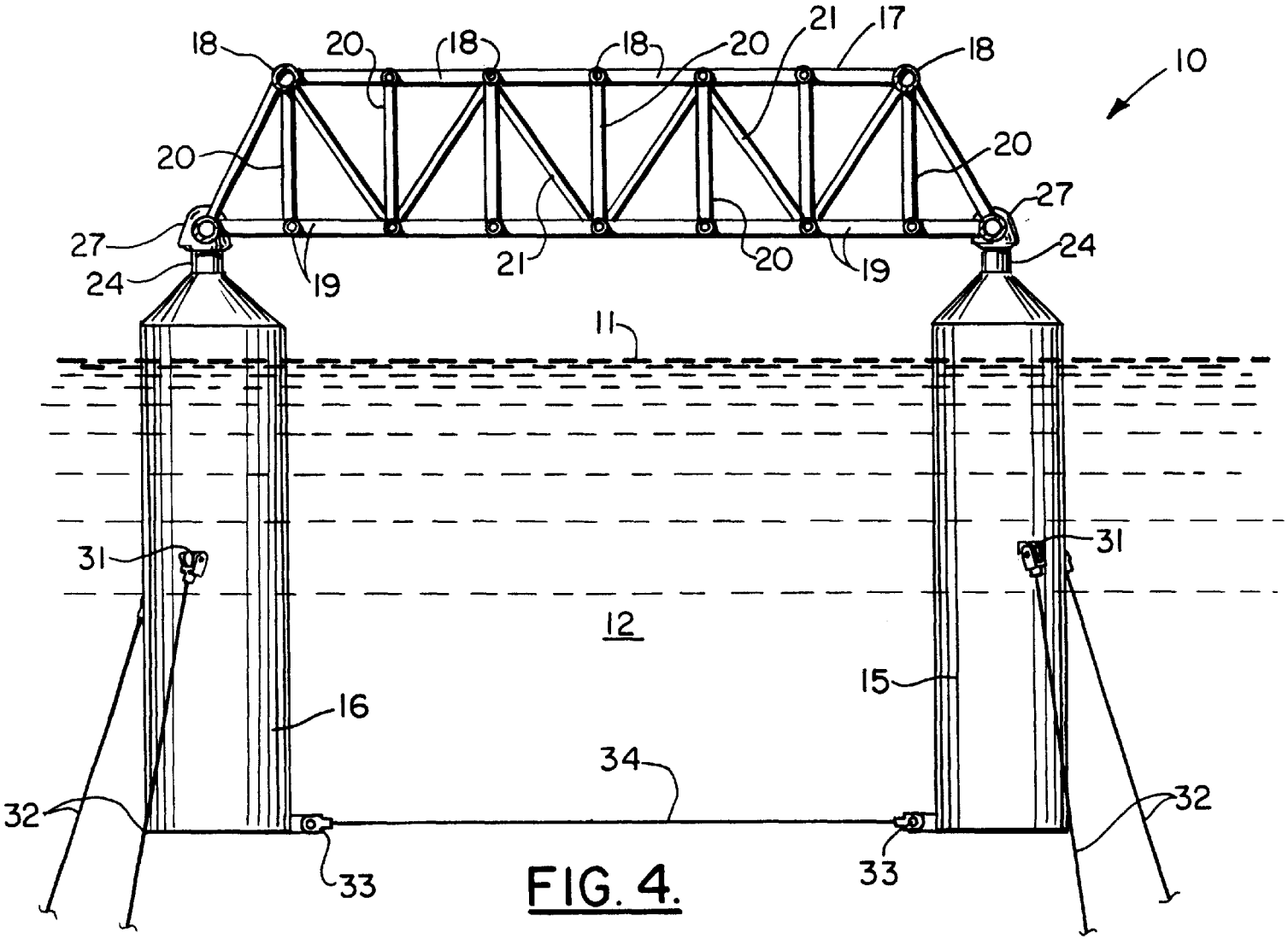
FIG. 4 is another elevation view of a preferred embodiment of the apparatus of the present invention.

The plan view of FIG. 2 shows various orientations that could be used for either mooring lines 32 or mooring lines 41. One arrangement provides a plurality of three mooring lines 32 or 41 attached to each buoy 13–16, the mooring lines 32 or 41 being spaced about 120 degrees apart as shown in hard lines. In phantom lines in FIG. 2, another geometry for the mooring lines 32, 41 is shown, wherein there are two mooring lines for each buoy that are about 90 degrees apart.

The platform 17 is constructed of upper and lower sets of horizontal members 18, 19; vertical members 20; and diagonal members 21.

Figure 9:
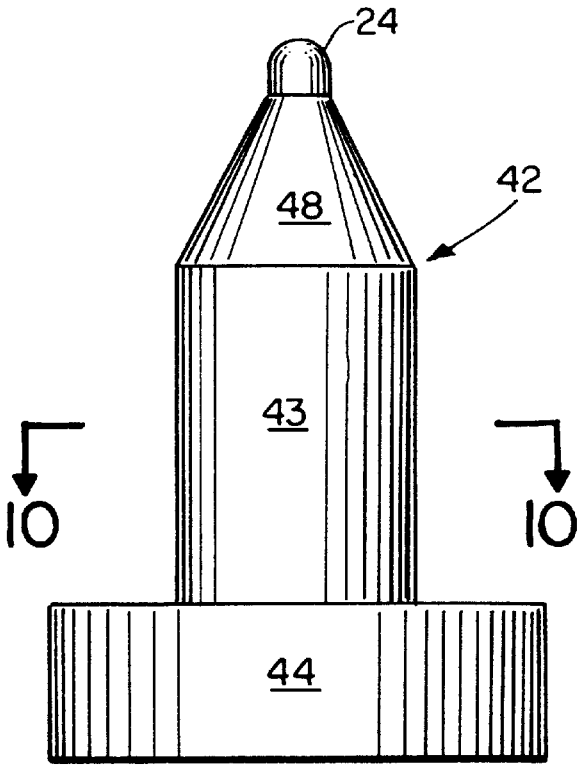
FIG. 9 is a partial elevation view of an alternate embodiment of the apparatus of the present invention that features buoys of variable diameter.
Figure 10:
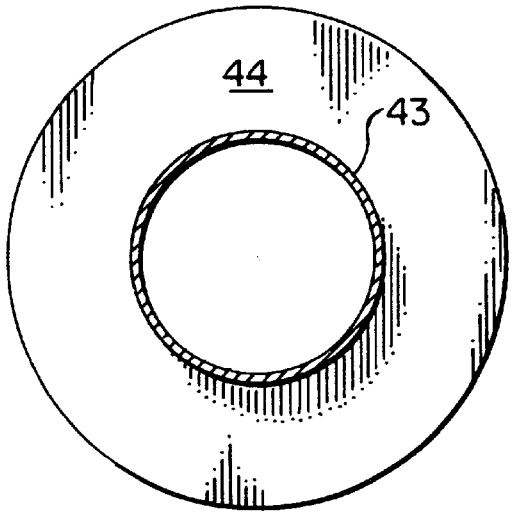
FIG. 10 is a sectional view taken along lines 10—10 of FIG. 9.
Figure 10A:
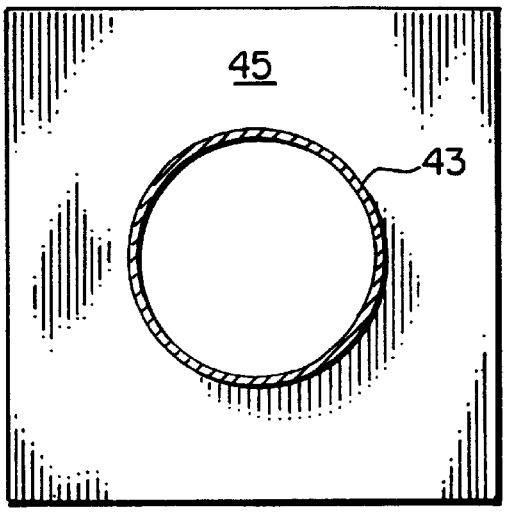
FIG. 10A is a sectional view taken along lines 10—10 of FIG. 9 and showing a buoy lower end portion that is square.

FIGS. 9, 10 and 10A show an alternate construction for each of the buoys. It should be understood that a buoy such as one of those shown in FIGS. 9, 10 or 10A could be used to replace any one or all of the buoys 13–16 shown in FIGS. 1–4 and 5–6.

Buoy 42 can be provided with a variable diameter having a smaller diameter cylindrical middle section 43, and a larger diameter lower section 44 which can be for example, either cylindrical (See FIG. 10) or squared (see FIG. 10A). The cylindrical lower section 44 is shown in FIGS. 9 and 10, and the squared lower section 45 shown in FIG. 10A.

Figure 11:
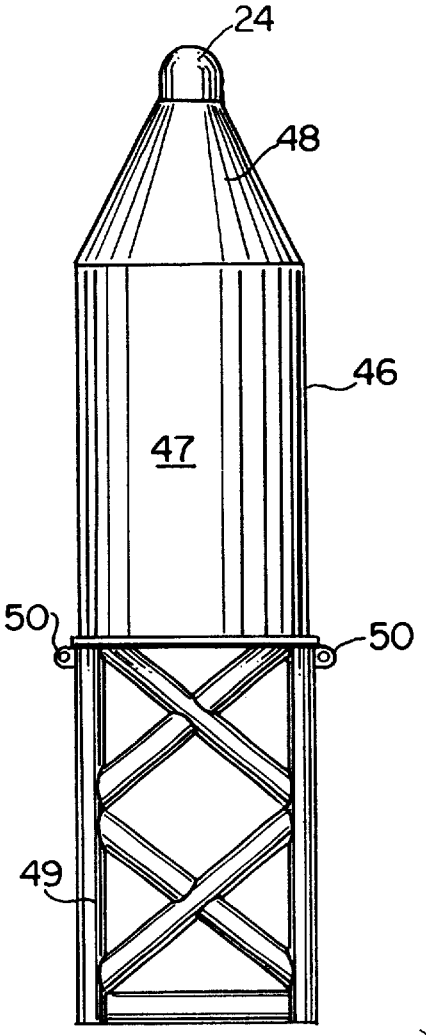
FIG. 11 is a partial elevation view of a third embodiment of the apparatus of the present invention showing an alternate buoy construction.
Figure 12:
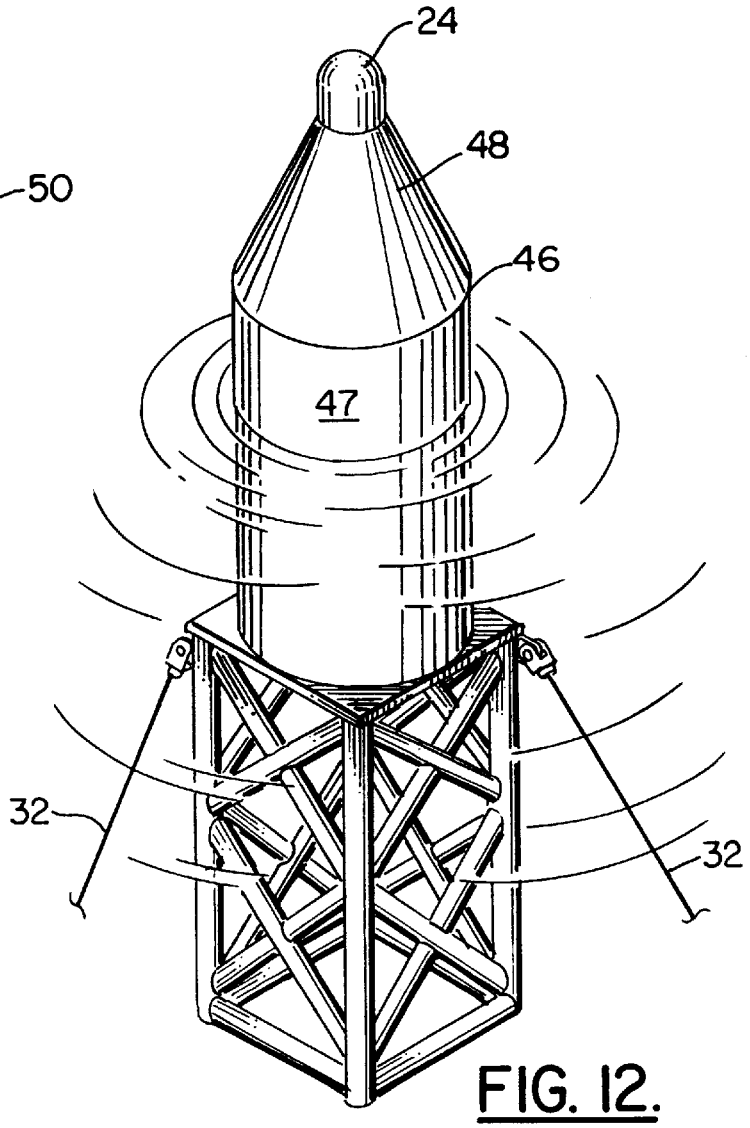
Fig. 12 is a perspective elevation view of a third embodiment of the apparatus of the present invention showing an alternate buoy construction.

Another buoy construction is shown in FIGS. 11 and 12. It should be understood that the buoy shown in FIGS. 11 and 12 could be used to replace any one or all of the plurality of buoys 13–16 of FIGS. 1–6. In FIGS. 11 and 12, the buoy 46 has a cylindrical middle section 47, a conical upper section 48, and a trussed lower section 49. Padeyes 50 on the upper end portion of trussed lower section 49 can be used to support any of the afore described mooring lines such as 32, 39, or 41. In the embodiment of FIGS. 11 and 12, each of the buoys 46 can have a similar construction and configuration at the upper end portion to that of a preferred embodiment shown in FIGS. 1–6, providing a conical upper section 48 and a attachment portion 24.

Figure 14:
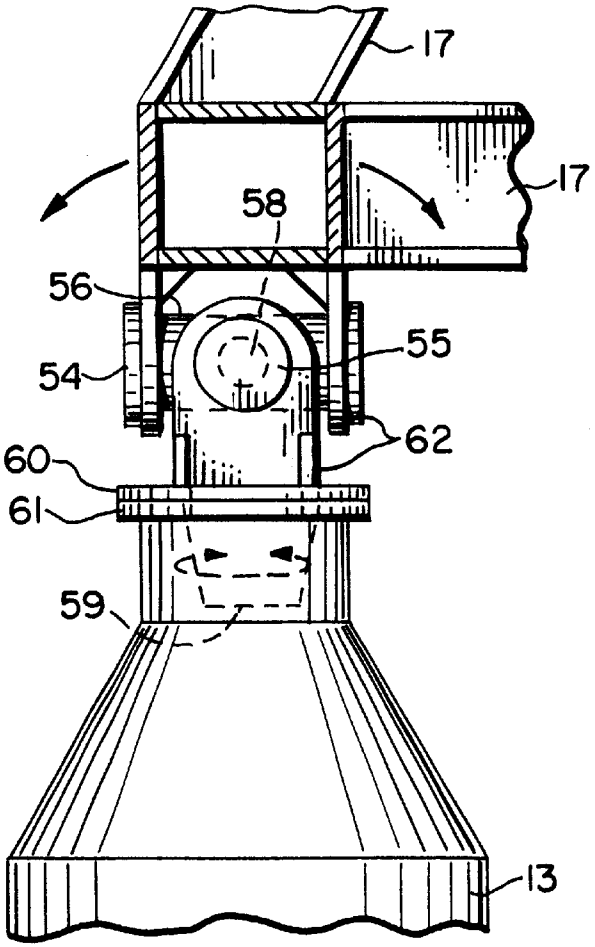
FIGS. 13–14 are elevation views of a fourth embodiment of the apparatus of the present invention showing an alternate articulating connection between each buoy and the platform
Figure 13:
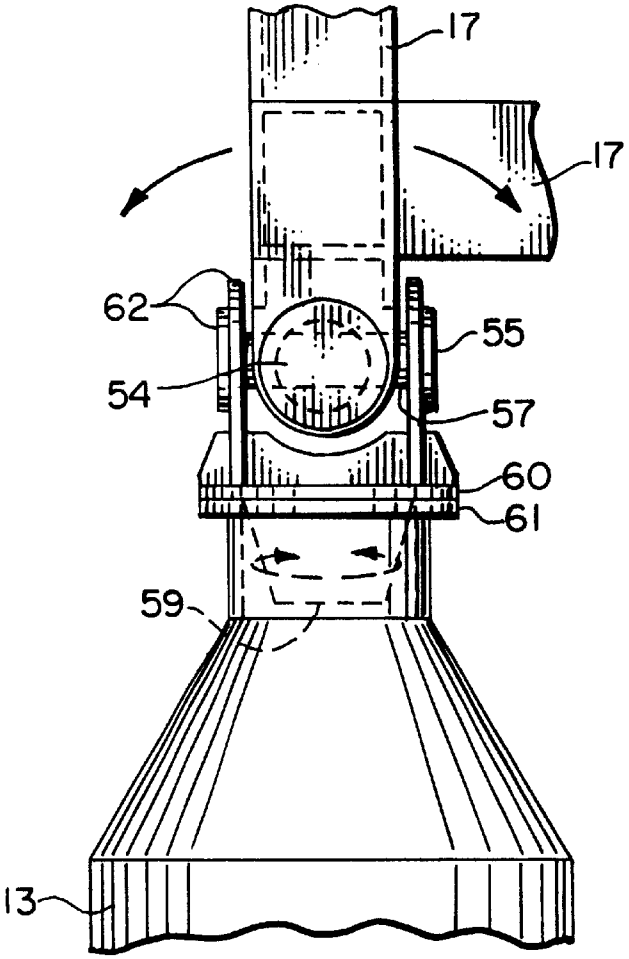

In FIGS. 13 and 14, there can be seen an alternate articulating connection between platform 17 and a selected buoy 13 (or 14–16 or 42, or 46). A gimble or universal joint 62 arrangement is shown in FIGS. 13 and 14, providing a first pinned connection at 54 and a second pinned connection at 55. The first pin 56 can be of a larger diameter, having a central opening 58 through which the second, smaller diameter pin 57 passes as shown. The central longitudinal axes of the pins 54, 55 preferably intersect. Arrow 59 in FIGS. 13–14 shows that a buoy can optionally be made to rotate relative to the gimbal connection shown. Bearing plates 60, 61 can rotate relative to one another. To minimize frictional force transference and wear, both pins can be mounted in bearings.

Figure 15:
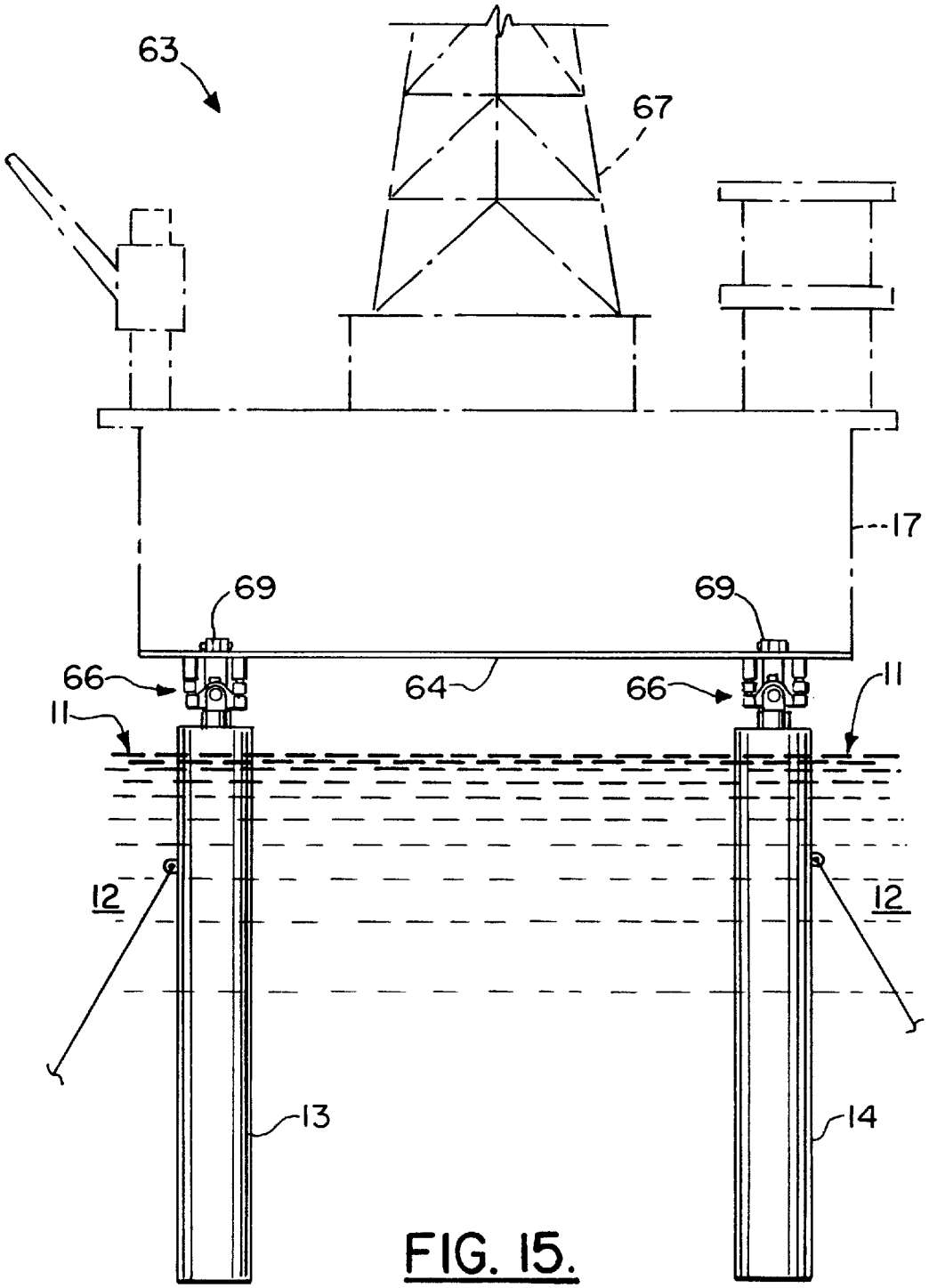
FIG. 15 is a schematic elevation view of a fifth embodiment of the apparatus of the present invention.
Figure 17:
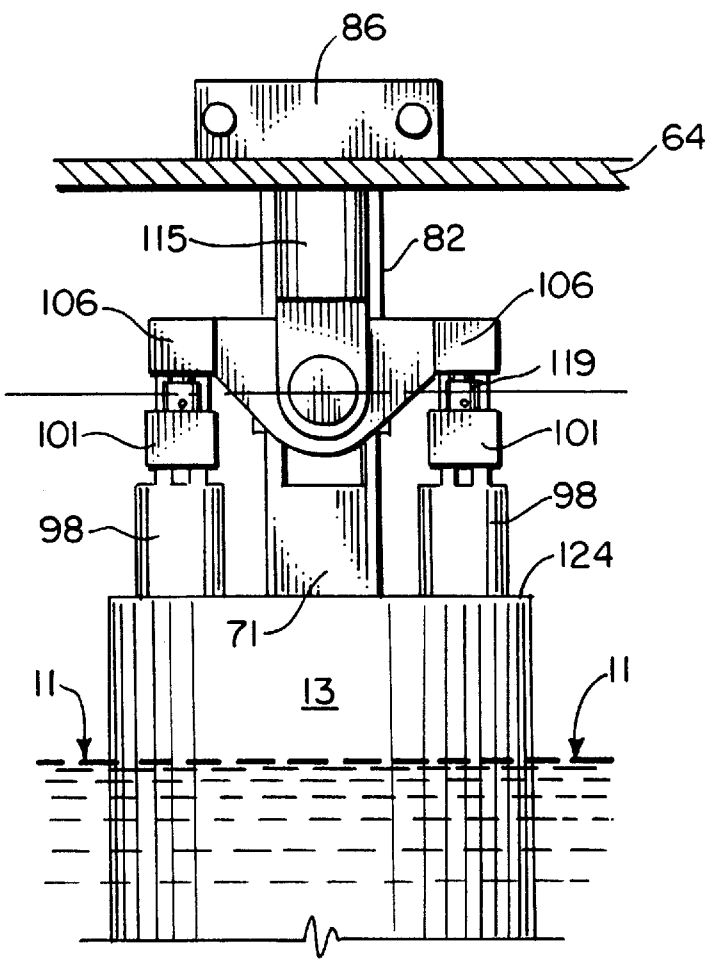
FIG. 17 is a side elevation view taken along lines 17—17 of FIG. 16.
Figure 16:
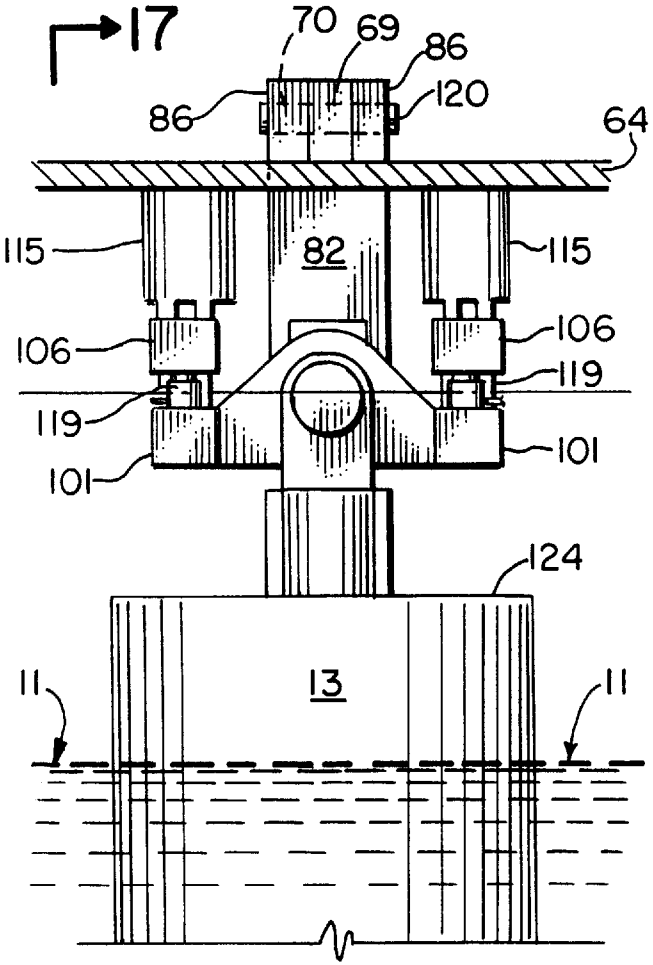
FIG. 16 is a partial elevation view of the fifth embodiment of the apparatus of the present invention.
Figure 19:
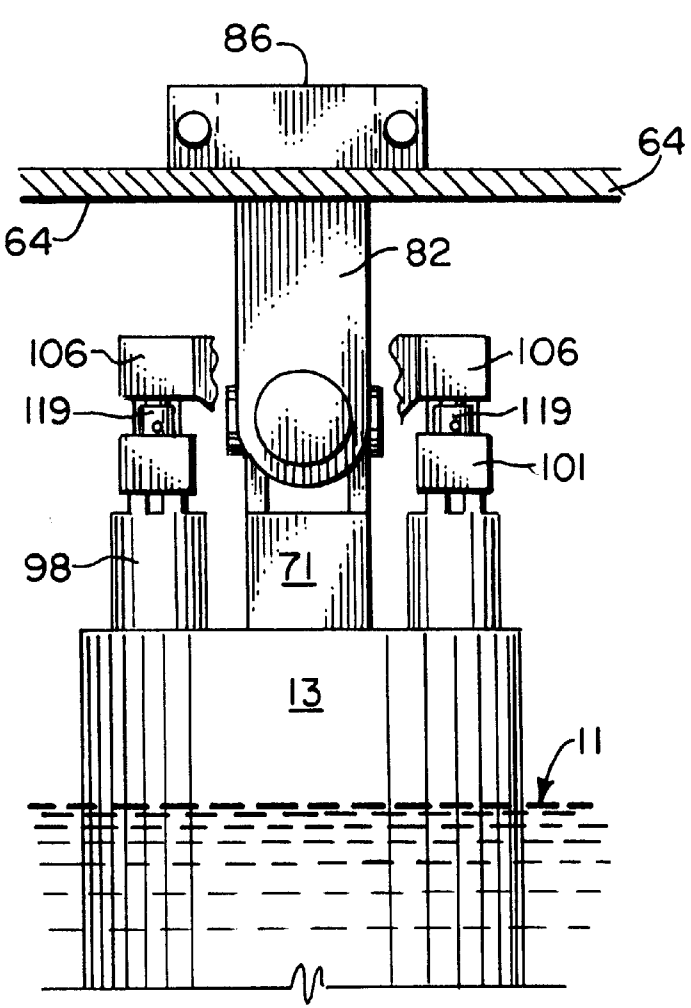
FIG. 19 is a partially cut away elevation view of the fifth embodiment of the apparatus of the present invention.
Figure 18:
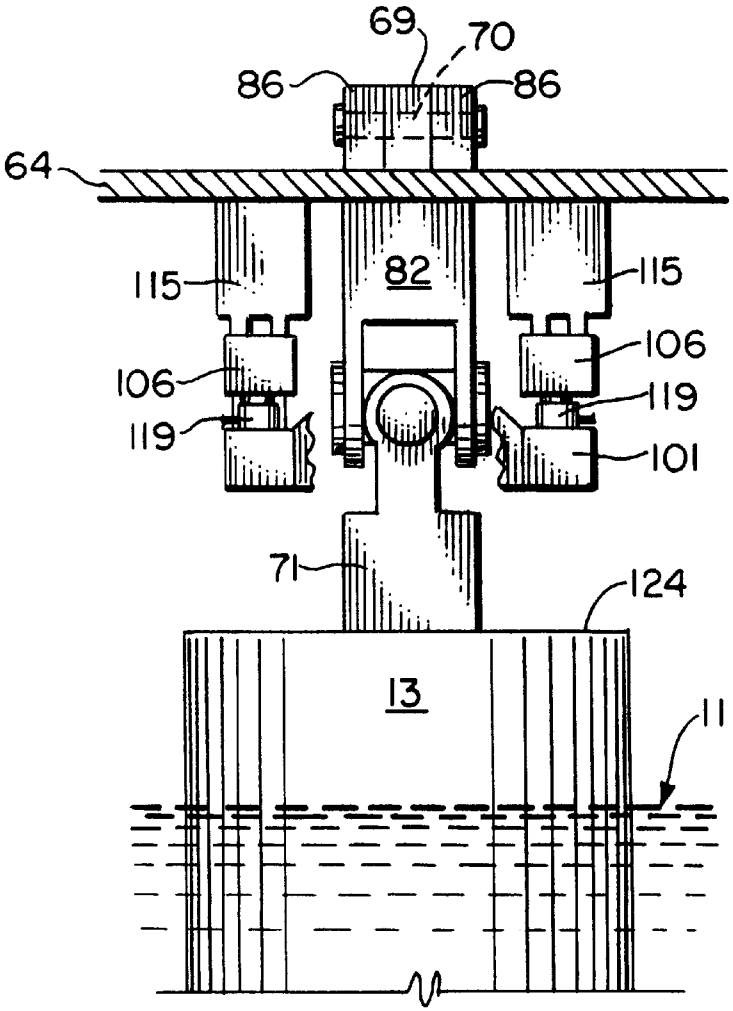
FIG. 18 is a partially cut away elevation view of the fifth embodiment of the apparatus of the present invention.
Figure 21:
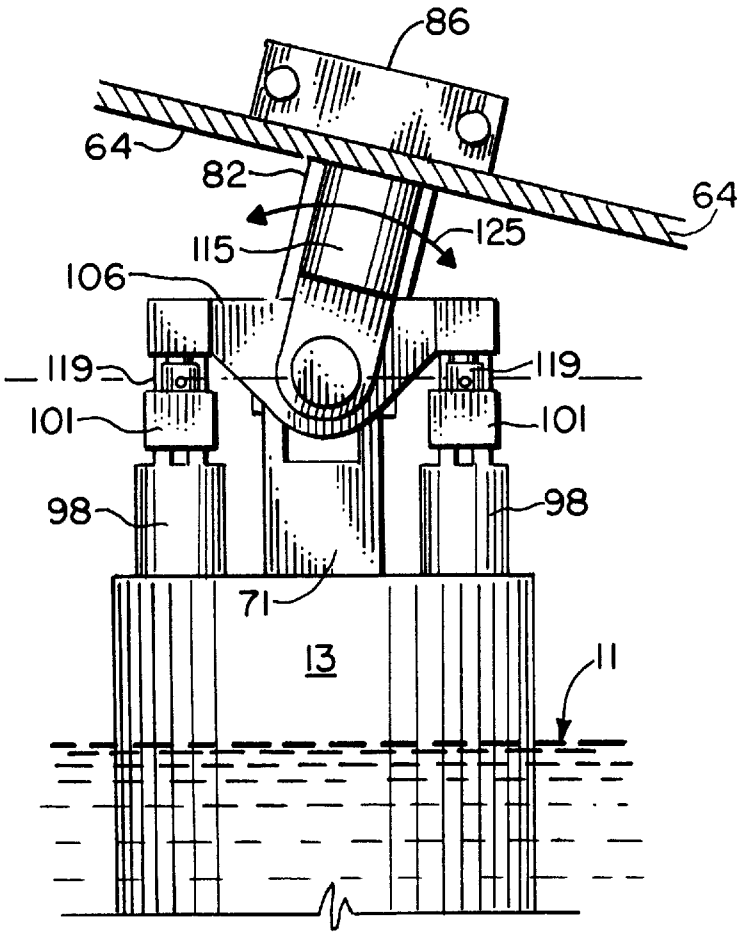
FIG. 21 is an elevation view of the fifth embodiment of the apparatus of the present invention showing an angled position of the platform relative to the buoys.
Figure 20:
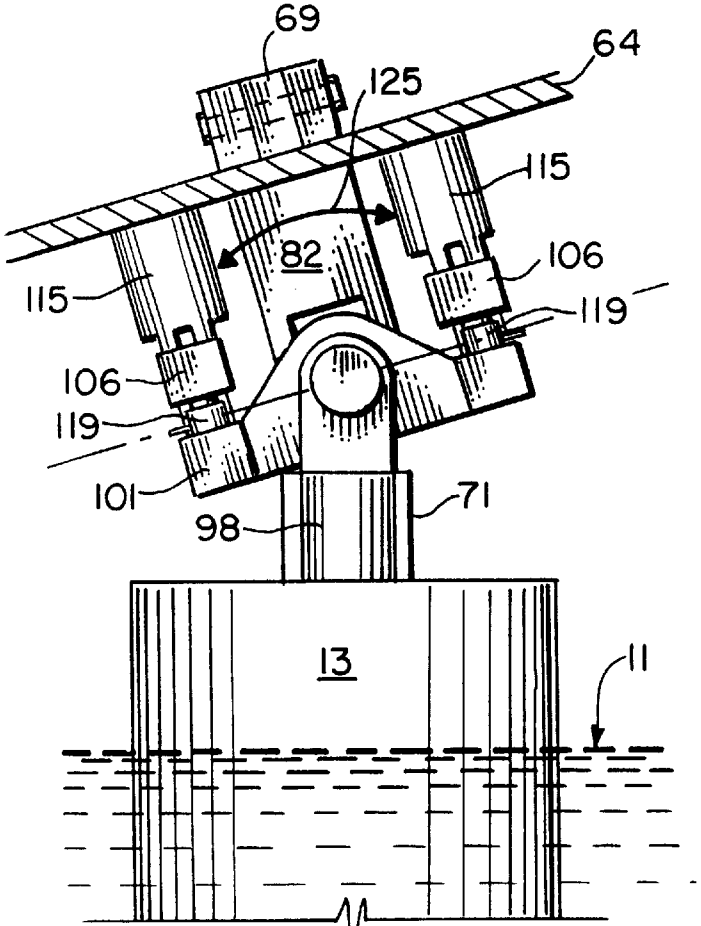
FIG. 20 is an elevation view of the fifth embodiment of the apparatus of the present invention showing an angled position of the platform relative to the buoys.

FIGS. 15–25 show the fifth embodiment of the apparatus of the present invention, designated generally by the numeral 63 in FIG. 15. Floating marine platform apparatus 63 is shown in FIG. 15 as including a platform 17 that can include a structural deck, package, platform, trussed deck or the like which has been shown in phantom lines in FIG. 15. It should be understood that platform 17 shown in FIG. 15 can include a structural deck 64 or any other structural frame that is known in the art for supporting an offshore oil and gas well drilling platform, and oil and gas well production facility, or an oil and gas well drilling and production facility 67.

Platform 17 can include thus a structural deck which is schematically illustrated using the numeral 64 in FIGS. 15–25 including a superstructure (e.g. with an oil drilling platform, oil production platform, crew quarters, heliport, vessels, and the like). A plurality of connections are shown, a connection interfacing between each buoy 13, 14, 15, 16 and the platform 17 to be supported.

In the embodiment of FIGS. 15–25, the connection that is positioned in between each buoy such as buoy 13 and platform 17 is preferably a connection that includes first and second connection devices and a load transfer mechanism that can transfer at least some of the platform load from one of the devices to the other device.

Figure 24:
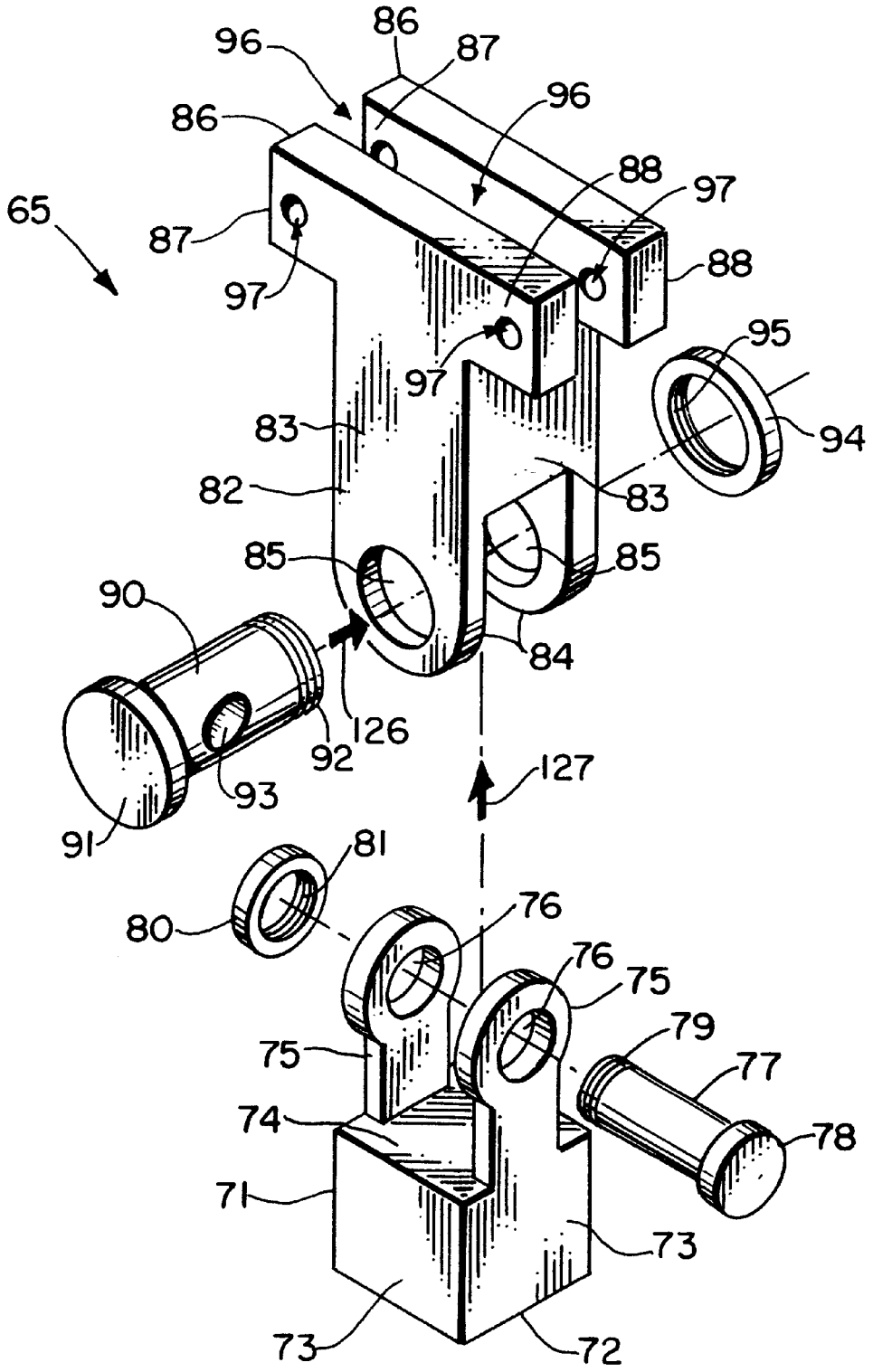
FIG. 24 is a partial perspective, exploded view of the fifth embodiment of the apparatus of the present invention illustrating the internal universal joint.
Figure 25:
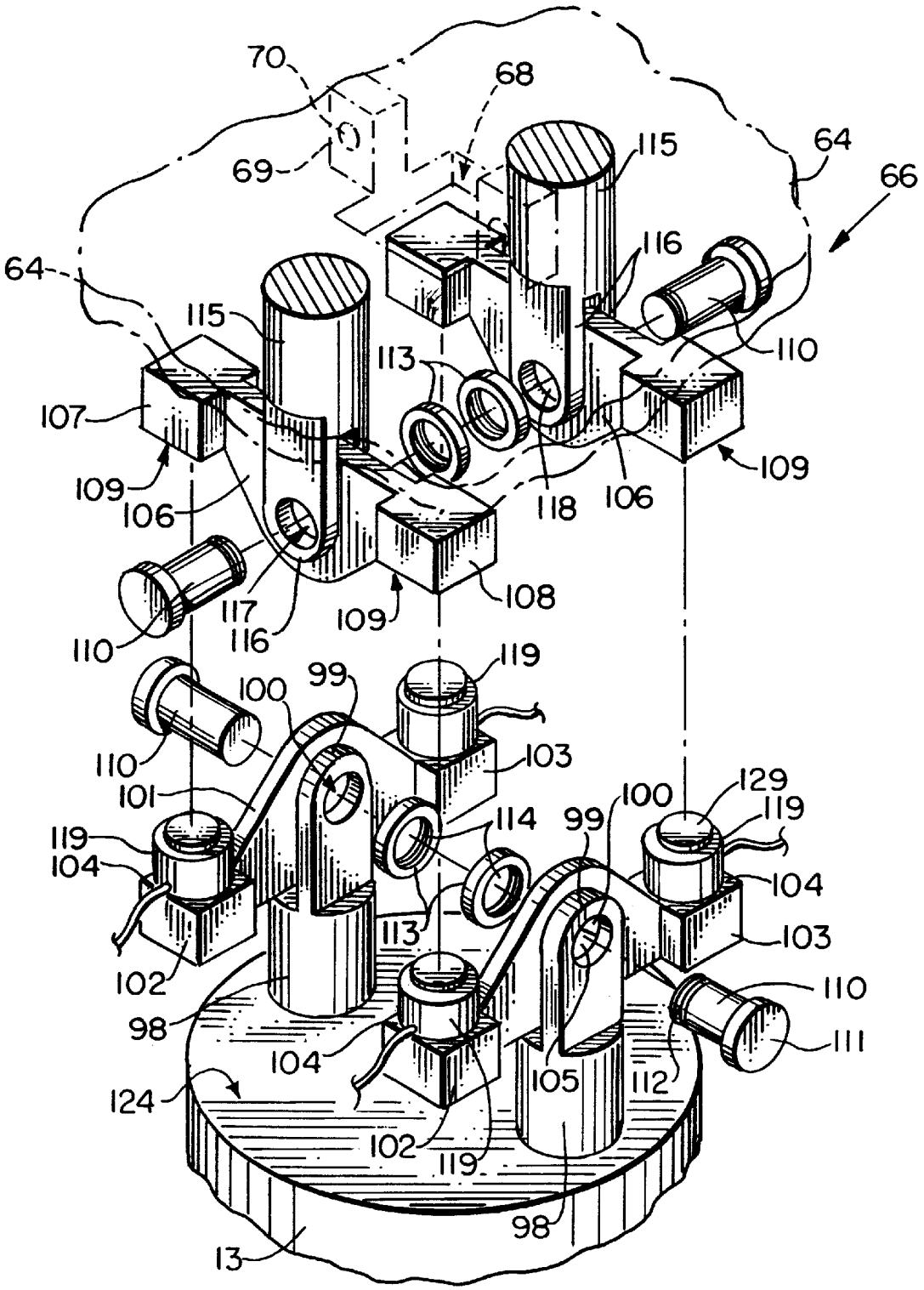
FIG. 25 is a partial perspective, exploded view of the fifth embodiment of the apparatus of the present invention showing the external universal joint.

In the fifth embodiment, these devices preferably include an internal device 65 (see FIG. 24) and an external device 66 (see FIG. 25). In the embodiment of FIGS. 15–25, the internal 65 and external 66 devices are preferably articulating connections. In the embodiment of FIGS. 15–25, the devices 65, 66 are preferably each universal joint connections.

In the embodiment of FIGS. 15–25, a load transfer mechanism enables load to be transferred from one of the devices 65 or 66 to the other device 65 or 66. This load transfer mechanism is preferably a jacking system such as the plurality of hydraulic jacks 119 that are shown in the drawings.

In FIG. 25, a deck opening 68 is shown through which the internal device 65 can be removed for servicing. The internal device 65 can be the device that typically carries a portion of the platform load for a majority of the time and transfers that load to its buoy such as buoy 13. At deck opening 68, padeyes 69 are provided each having an opening 70 as shown in FIG. 25.

Figure 22:
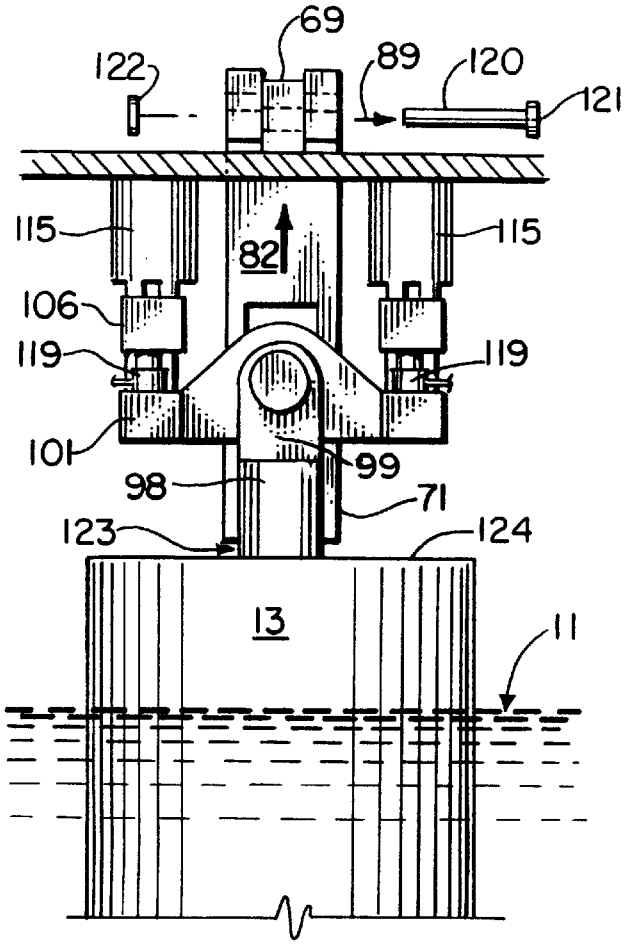
FIG. 22 is a partial elevation view of the fifth embodiment of the apparatus of the present invention illustrating removal of the pin for servicing the internal universal joints.

The details of construction of the internal device 65 are shown in FIG. 24. The internal device 65 includes a lower section 71, and upper section 82, and pins 77, 90. The lower section 71 has a bottom 72 that transfers load to the upper surface 124 of buoy 13. When load is to be transferred to the second device 66 of FIG. 25, a jacking mechanism such as the plurality of hydraulic jacks 119 lift the lower section 71 from upper surface 124 of buoy 13, as shown in FIG. 22. A gap 123 is then present in between the upper surface 124 of buoy 13 and the bottom 72 of lower section 71. In such a position (shown in FIG. 22), pin 120 can be removed and the internal device 65 can be lifted upwardly and withdrawn through opening 68 in structural deck 64.

Lower section 71 has sides 73, a top 74 and a pair of padeyes 75 that are spaced apart and which extend from the top 74. Each padeye 75 has pin opening 76. A smaller pin 77 has enlarged head 78 and externally threaded section 79. Nut 80 provides an internally threaded section 81 that enables the nut 80 to be threadably engaged to the pin 77 at threads 79. Upper section 82 of internal device 65 provides sides 83 and padeyes 84 that extend downwardly as shown in FIG. 24, each padeye 84 providing a pin opening 85.

Upper section 82 provides a pair of spaced apart beams 86, each having end portions 87, 88. Each end portion 87, 88 provides a pin opening 97. A larger pin 90 fits through openings 85 as indicated schematically by arrow 126 in FIG. 24. Pin 90 has enlarged head 91, and externally threaded section 92. Larger pin 90 also provides an opening 93 that is positioned in between externally threaded section 92 and head 91 as shown in FIG. 24.

Nut 94 has internally threaded section 95 that enables the nut to be threadably engaged with the larger pin 90. A gap 96 is provided in between the beams 86 so that padeyes 69 on structural deck 64 fit in between the spaced apart beams 86 in gap 96 as shown in the drawings (see FIGS. 16 and 18). In this position, the openings 70 of padeyes 69 align with the openings 97 of beams 86. Pins 120 can then be placed through the aligned openings 70, 97. Upon assembly of the device 65, larger pin 90 is first passed through openings 85 of padeyes 84. Nut 94 is then threadably engaged with pin 90 at correspondingly engaging threaded portions 92, 95. The pin 77 is then placed through one of the openings 76 of padeye 75, and then through opening 93 of larger pin 90 and then through the opposite opening 76 of padeye 75. Nut 80 then retains smaller pin 77 by engaging the threaded portions 79, 81. In this position, the internal device 65 defines a first universal joint (see FIG. 23) that can be removed as shown by arrow 128 in FIG. 23 for servicing.

The devices 65, 66 can be universal joints as shown. Each of the universal joints each have multiple pins 77,90 (for device 65) and 110 (for device 66) with central longitudinal axes, the central axes of the pins 77, 90 and 110 of both universal joints occupying a common plane during use.

When the internal device 65 is removed for servicing, the external device 66 carries a portion of the platform load between structural deck 64 and buoy 13. The external device 66 is shown more particularly in FIG. 25. External device 66 includes a pair of spaced apart lower supports 98, each having a pair of spaced apart padeyes 99, each of the padeyes 99 providing a pin opening 100.

A pair of lower beams 101 are provided, a beam 101 being pivotally attached to each lower support 98 as shown in FIG. 25. Each lower beam 101 provides end portions 102, 103, each of the end portions 102, 103 providing an upper surface 104 that carries a hydraulic jack 119. Each of the lower beams 101 provides a beam opening 105 that receives a pin 110 when the opening 105 aligns with openings 100 of padeyes 99.

The external device 66 includes a pair of spaced apart supports 115 that are connected (eg. welded or bolted) to the underside of structural deck 64 for transferring load from the external device 66 to structural deck 64. Upper beams 106 are pivotally attached to upper supports 115 using pins 110. Each of the upper supports 115 has a pair of spaced apart padeyes 116, each padeye 116 having an opening 117 for receiving a pin 110. Each upper beam 106 provides end portions 107, 108 having a lower surface 109 that is engaged by an elevating portion 129 of hydraulic jack 119 when load is to be carried by the external device 66. It should be understood that the hydraulic jacks 119 are commercially available such as from Enerpac.

Each pin 110 has an enlarged head 111 and an externally threaded section 112. Pins 110 are retained in position using nuts 113. Each nut 113 has an internally threaded section 114 that engages the externally threaded section 112 of pin 110. Each of the upper beams 106 has a beam opening 118 that receives pin 110. In order to effect the pivotal connection between upper supports 115 and upper beams 106, pins 110 are passed through the openings 117 of padeyes 116 and the beam openings 118. The pins 110 are then secured by fastening a nut 113 to threaded section 112.

Figure 23:
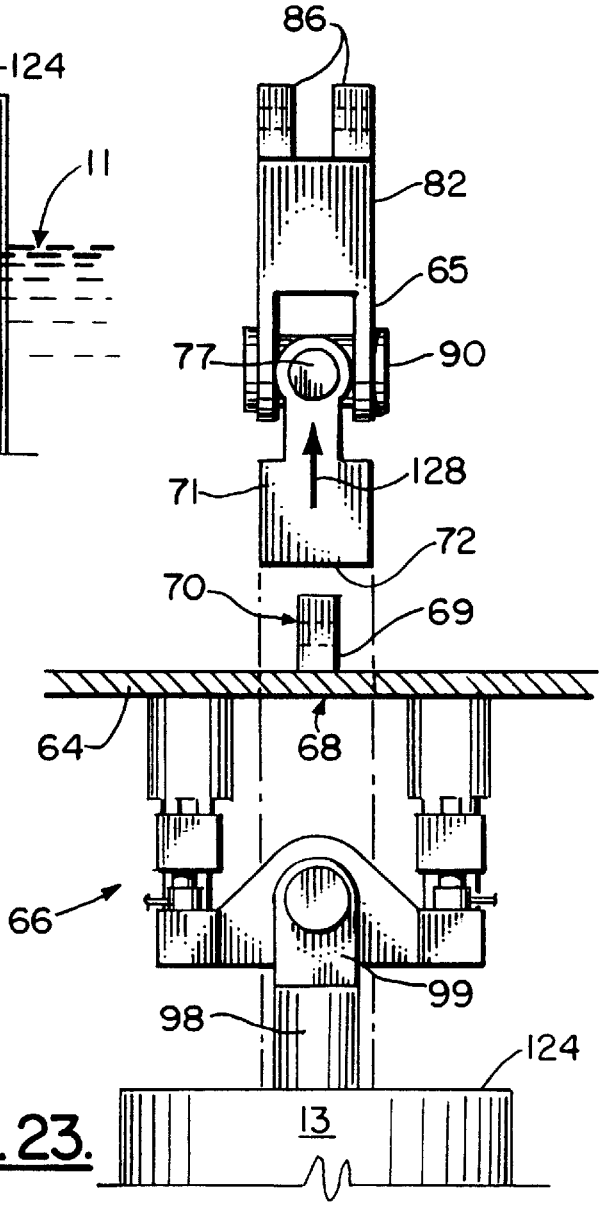
FIG. 23 is another partial elevation view of the fifth embodiment of the apparatus of the present invention showing removal of the internal universal joint.

In the embodiment of FIGS. 15–25, it is preferable that the internal device 65 carry load between a buoy (for example 13), and structural deck 64 a majority of the time. Therefore, there is typically a small gap between the elevating portion 129 of each jack 119 and the undersurface 109 of beam ends 107, 108. In such a situation, the bottom 72 of lower section 71 of internal device 65 bears against the upper surface 124 of buoy 13. In order to service the internal device 65 (or to replace it), the hydraulic jacks 119 are actuated so that elevating portion 129 elevates until the elevating portion 129 engages lower surface 109 of each beam end 107, 108. Continued elevation of the jack 119 elevating portions 129 causes upper beams 106 to move away from lower beams 101. Such elevating of the jacks 119 increases the distance between structural deck 64 and the upper surface 124 of each buoy 13, 14, 15, 16. Eventually, the lower surface 72 of the lower section 71 rises above upper surface 124 of buoy 113 (see FIG. 22) thus removing platform load from the internal device 65. Pin 120 is then removed by disassembly of retainer nut 122 from pin 120 as schematically indicated by arrow 89 in FIG. 22. A gap 123 between lower section 71 and buoy 13 is shown in FIG. 22. Arrow 128 in FIG. 23 schematically illustrates the lifting of internal device 65 upwardly for removal and servicing. The external device 66 in FIG. 23 now carries load between structural deck 64 and buoy 13.

Each of the buoys will move due to current and/or wind and/or wave action or due to other dynamic marine environmental factors. "Articulating connection" as used herein should be understood to mean any connection or joint that connects a buoy to the superstructure, transmits axial and shear forces, and allows the support buoy(s) to move relative to the superstructure without separation, and wherein the bending moment transferred to the superstructure from one of the so connected buoys or from multiple of the so connected buoys is reduced, minimized or substantially eliminated.

PARTS LIST

| PART NUMBER | DESCRIPTION |
|---|---|
| 10 | floating marine platform apparatus |
| 11 | water surface |
| 12 | ocean |
| 13 | buoy |
| 14 | buoy |
| 15 | buoy |
| 16 | buoy |
| 17 | platform |
| 18 | upper horizontal member |
| 19 | lower horizontal member |
| 20 | vertical member |
| 21 | diagonal member |
| 22 | upper end portion |
| 23 | conical shape |
| 24 | attachment portion |
| 25 | convex surface |
| 26 | concave surface |
| 27 | connecting portion |
| 28 | central longitudinal axis |
| 29 | plane |
| 30 | internal reinforcing plate |
| 31 | upper padeye |
| 32 | mooring line |
| 33 | lower padeye |
| 34 | horizontal mooring line |
| 35 | internal reinforcing plate |
| 36 | upper curved plate |
| 37 | lower curved plate |
| 38 | conical plate |
| 39 | tensioned mooring line |
| 40 | padeye |
| 41 | caternary mooring line |
| 42 | buoy |
| 43 | cylindrical middle section |
| 44 | cylindrical lower section |
| 45 | square lower section |
| 46 | buoy |
| 47 | cylindrical middle section |
| 48 | conical upper section |
| 49 | trussed lower section |
| 50 | padeye |
| 51 | sea bed |
| 52 | anchor |
| 53 | drilling/production facility |
| 54 | first pinned connection |
| 55 | second pinned connection |
| 56 | pin |
| 57 | pin |
| 58 | opening |
| 59 | arrow |
| 60 | bearing plate |
| 61 | bearing plate |
| 62 | universal joint |
| 63 | floating marine platform apparatus |
| 64 | structural deck |
| 65 | internal device |
| 66 | external device |
| 67 | facility |
| 68 | deck opening |
| 69 | padeye |
| 70 | opening |
| 71 | lower section |
| 72 | bottom |
| 73 | side |
| 74 | top |
| 75 | padeye |
| 76 | pin opening |
| 77 | smaller pin |
| 78 | enlarged head |
| 79 | externally threaded section |

-continued

PARTS LIST

| PART NUMBER | DESCRIPTION |
|---|---|
| 80 | nut |
| 81 | internally threaded section |
| 82 | upper section |
| 83 | side |
| 84 | padeye |
| 85 | pin opening |
| 86 | beam |
| 87 | end portion |
| 88 | end portion |
| 89 | arrow |
| 90 | larger pin |
| 91 | enlarged head |
| 92 | externally threaded section |
| 93 | opening |
| 94 | nut |
| 95 | internally threaded section |
| 96 | gap |
| 97 | pin opening |
| 98 | lower support |
| 99 | padeye |
| 100 | pin opening |
| 101 | lower beam |
| 102 | end |
| 103 | end |
| 104 | upper surface |
| 105 | beam opening |
| 106 | upper beam |
| 107 | end |
| 108 | end |
| 109 | lower surface |
| 110 | pin |
| 111 | enlarged head |
| 112 | externally threaded section |
| 113 | nut |
| 114 | internally threaded section |
| 115 | upper support |
| 116 | padeye |
| 117 | pin opening |
| 118 | beam opening |
| 119 | jack |
| 120 | pin |
| 121 | enlarged head |
| 122 | retainer nut |
| 123 | gap |
| 124 | top of buoy |
| 125 | arrow |
| 126 | arrow |
| 127 | arrow |
| 128 | arrow |
| 129 | elevating portion |

The foregoing embodiments are presented by way of example only; the scope of the present invention is to be limited only by the following claims.

What is claimed is:

1. A marine platform, comprising:

a) a plurality of individual buoys;

b) a platform having an oil and gas well producing facility and a peripheral portion that includes plurality of connecting positions, one connecting position for each buoy; and a plurality of connections that connect the buoys to the platform at respective connecting positions, each connection allowing for buoy motion induced by sea movement while reducing sea movement effect on the platform; and d) the connection including first and second connection devices that enable removal of one of the connection devices for servicing, the other device connecting the buoy to the platform during such servicing.

2. The marine platform of claim 1 further comprising a mooring extending from a plurality of the buoys for holding the platform and buoys to a desired location.

3. The marine platform of claim 1 wherein the connections include universal joints.

4. The marine platform of claim 1 wherein each of the devices is a universal joint.

5. The marine platform of claim 1 wherein the devices include an internal device and an external device.

6. The marine platform of claim 1 wherein the devices include an internal universal joint and an external universal joint.

7. The marine platform of claim 1 wherein each buoy has a height and a diameter, the height being greater than the diameter.

8. The marine platform of claim 1 wherein there are at least three buoys and at least three connecting positions.

9. The marine platform of claim 1 wherein there are at least four buoys and at least four connecting positions.

10. The marine platform of claim 1 wherein there are between 3 and 8 connecting positions.

11. The marine platform of claim 1 wherein the platform is comprised of a trussed deck.

12. The marine platform of claim 1 wherein the trussed deck has lower horizontal members, upper horizontal members, and a plurality of inclined members spanning between the upper and lower horizontal members.

13. The marine platform of claim 1 wherein each buoy is between 100 and 500 feet in height.

14. The marine platform of claim 1 wherein each buoy is between about 25 and 100 feet in diameter.

15. The marine platform of claim 1 wherein each buoy has a generally uniform diameter over a majority of its length.

16. The marine platform of claim 1 wherein each buoy has an upper end portion that is generally cylindrically shaped.

17. The marine platform of claim 1 further comprising a device load transfer mechanism, wherein one of the devices can be loaded with the load transfer mechanism so that the other device is unloaded.

18. The marine platform of claim 1 wherein the buoys support a platform that weighs between 500 and 100,000 tons.

19. marine platform, comprising:

a) a plurality of buoys;

b) a platform having an oil and gas well producing facility weighing between 500 tons and 100,000 tons and a peripheral portion that includes a plurality of connecting positions, one connecting position for each buoy; and c) a plurality of connections that connect the buoys to the platform at respective connecting positions, each connection allowing for buoy motion induced by sea movement while reducing sea movement effect on the platform;

d) the connection between each buoy and the platform including first and second articulating devices and a load transfer mechanism that enables at least some of the platform load to be transferred from one device to the other device, enabling one of the devices to be serviced.

20. The marine platform of claim 19 further comprising a mooring extending from a plurality of the buoys for holding the platform and buoys to a desired location.

21. The marine platform of claim 19 wherein the connection devices are universal joints.

22. The marine platform of claim 19 wherein each of the connections includes an inner device surrounded by an external device.

23. The marine platform of claim 22 wherein the inner device is an articulating portion.

24. The marine platform of claim 19 wherein the outer device is an articulating portion.

25. The marine platform of claim 19 wherein each buoy has a height and a diameter, the height being greater than the diameter.

26. The marine platform of claim 19 wherein there are at least three buoys and at least three connecting positions.

27. The marine platform of claim 19 wherein there are at least four buoys and at least four connecting positions.

28. The marine platform of claim 19 wherein the platform is comprised of a trussed deck.

29. The marine platform of claim 19 wherein the trussed deck has lower horizontal members, upper horizontal members, and a plurality of inclined members spanning between the upper and lower horizontal members.

30. The marine platform of claim 19 wherein each buoy is between 100 and 500 feet in height.

31. The marine platform of claim 19 wherein each buoy is between about 25 and 100 feet in diameter.

32. The marine platform of claim 19 wherein each buoy has a generally uniform diameter over a majority of its length.

33. A marine platform, comprising:

a) a plurality of buoys;

b) a platform having an oil and gas well producing facility and a peripheral portion that includes a plurality of connecting positions, one connecting position for each buoy; and c) a plurality of connections that connect the buoys to the platform at respective connecting positions, each connection allowing for buoy motion induced by sea movement while reducing sea movement effect on the platform; and d) each connection having means for enabling a transfer of at least a portion of the platform load from a first portion of the connection to a second portion of the connection so that a first portion of the connection can be serviced.

34. The marine platform of claim 33 wherein the means for enabling includes a first connection device, a second connection device and a mechanism that transfers load between the first and second devices.

35. The marine platform of claim 34 wherein the first connection device is a universal joint.

36. The marine platform of claim 34 wherein the first connection device is an articulating connection device.

37. The marine platform of claim 34 wherein the second connection device is a universal joint.

38. The marine platform of claim 34 wherein the second connection device is an articulating connection device.

39. The marine platform of claim 33 wherein the connections include universal joints.

40. The marine platform of claim 33 wherein each buoy is between 100 and 500 feet in height.

41. The marine platform of claim 33 wherein each buoy is between about 25 and 100 feet in diameter.

42. The marine platform of claim 39 wherein the universal joints each have multiple pins with central longitudinal axes, the central axes of the pins of both universal joints occupying a common plane during use.

43. A marine platform, comprising:

a) a plurality of buoys;

b) a platform superstructure having an oil and gas well producing facility and a plurality of connecting positions, one connecting position for each buoy; and c) a plurality of connections that connect the buoys to the platform at respective connecting positions, each connection allowing for buoy motion induced by sea movement while reducing sea movement effect on the platform; and d) each connection including first and second connection devices that enable removal of one of the connection devices for servicing, while the other device is simultaneously connecting the buoy to the platform and effecting load transfer between the buoy and the platform superstructure during such servicing.

44. The marine platform of claim 43 further comprising a mooring extending from a plurality of the buoys for holding the platform and buoys to a desired location.

45. The marine platform of claim 43 wherein the connections include universal joints.

46. The marine platform of claim 43 wherein each of the devices is a universal joint.

47. The marine platform of claim 43 wherein the devices include an internal device and an external device.

48. The marine platform of claim 43 wherein the devices include an internal universal joint and an external universal joint.

49. The marine platform of claim 43 wherein each buoy has a height and a diameter, the height being greater than the diameter.

50. The marine platform of claim 43 wherein there are at least three buoys and at least three connecting positions.

51. The marine platform of claim 43 wherein there are at least four buoys and at least four connecting positions.

52. The marine platform of claim 43 wherein there are between 3 and 8 connecting positions.

53. The marine platform of claim 43 wherein the platform is comprised of a trussed deck.

54. The marine platform of claim 43 wherein the trussed deck has lower horizontal members, upper horizontal members, and a plurality of inclined members spanning between the upper and lower horizontal members.

55. The marine platform of claim 43 wherein each buoy is between 100 and 500 feet in height.

56. The marine platform of claim 43 wherein each buoy is between about 25 and 100 feet in diameter.

57. The marine platform of claim 43 wherein each buoy has a generally uniform diameter over a majority of its length.

58. The marine platform of claim 43 wherein each buoy has an upper end portion that is generally cylindrically shaped.

59. The marine platform of claim 43 further comprising a device load transfer mechanism, wherein one of the devices can be loaded with the load transfer mechanism so that the other device is unloaded.

60. The marine platform of claim 43 wherein the buoys support a platform that weighs between 500 and 100,000 tons.

61. A marine platform, comprising:

a) a plurality of buoys;

b) a platform having an oil and gas well producing facility weighing between 500 tons and 100,000 tons and a peripheral portion that includes a plurality of connecting positions, one connecting position for each buoy; and c) a plurality of connections that connect the buoys to the platform at respective connecting positions, each connection allowing for buoy motion induced by sea movement while reducing sea movement effect on the platform; and d) said connection between each buoy and the platform including first and second articulating devices and a load transfer mechanism that enables at least some of the platform load to be transferred from one device to the other device so that one of the devices can be serviced.

62. The marine platform of claim 61 further comprising a mooring extending from a plurality of the buoys for holding the platform and buoys to a desired location.

63. The marine platform of claim 61 wherein the connection devices are universal joints.

64. The marine platform of claim 61 wherein each of the connections includes an inner device surrounded by an external device.

65. The marine platform of claim 64 wherein the inner device is an articulating portion.

66. The marine platform of claim 61 wherein the outer device is an articulating portion.

67. The marine platform of claim 61 wherein each buoy has a height and a diameter, the height being greater than the diameter.

68. The marine platform of claim 61 wherein there are at least three buoys and at least three connecting positions.

69. The marine platform of claim 61 wherein there are at least four buoys and at least four connecting positions.

70. The marine platform of claim 61 wherein the platform is comprised of a trussed deck.

71. The marine platform of claim 61 wherein the trussed deck has lower horizontal members, upper horizontal members, and a plurality of inclined members spanning between the upper and lower horizontal members.

72. The marine platform of claim 61 wherein each buoy is between 100 and 500 feet in height.

73. The marine platform of claim 61 wherein each buoy is between about 25 and 100 feet in diameter.

74. The marine platform of claim 61 wherein each buoy has a generally uniform diameter over a majority of its length.

75. A marine platform, comprising:

a) a plurality of buoys;

b) a platform having an oil and gas well producing facility and a peripheral portion that includes a plurality of connecting positions, one connecting position for each buoy; and c) a plurality of connections that connect the buoys to the platform at respective connecting positions, each of connection of a buoy to the platform being a separate connection allowing for buoy motion induced by sea movement while reducing sea movement effect on the platform; and d) said connection having means for enabling a transfer of at least a portion of the platform load from a first portion of the connection to a second portion of the connection so that the first portion of the connection can be serviced.

76. The marine platform of claim 75 wherein the means for enabling includes a first connection device, a second connection device and a mechanism that transfers load between the first and second devices.

77. The marine platform of claim 76 wherein the first connection device is a universal joint.

78. The marine platform of claim 76 wherein the first connection device is an articulating connection device.

79. The marine platform of claim 76 wherein the second connection device is a universal joint.

80. The marine platform of claim 76 wherein the second connection device is an articulating connection device.

81. The marine platform of claim 75 wherein the connections include universal joints.

82. The marine platform of claim 75 wherein each buoy is between 100 and 500 feet in height.

83. The marine platform of claim 75 wherein each buoy is between about 25 and 100 feet in diameter.

84. The marine platform of claim 81 wherein the universal joints each have multiple pins with central longitudinal axes, the central axes of the pins of both universal joints occupying a common plane during use.

* * * * *